US012371924B2

(12) United States Patent
Huang et al.

(10) Patent No.: US 12,371,924 B2
(45) Date of Patent: Jul. 29, 2025

(54) ADJUSTABLE RACKING BARRIER SYSTEM

(71) Applicants: Yanming Huang, Hong Kong (CN); Jun Ma, Hong Kong (CN)

(72) Inventors: Yanming Huang, Hong Kong (CN); Jun Ma, Hong Kong (CN)

( * ) Notice: Subject to any disclaimer, the term of this patent is extended or adjusted under 35 U.S.C. 154(b) by 403 days.

(21) Appl. No.: 18/004,799

(22) PCT Filed: Mar. 18, 2021

(86) PCT No.: PCT/CN2021/081444

§ 371 (c)(1),
(2) Date: Jan. 9, 2023

(87) PCT Pub. No.: WO2022/193209

PCT Pub. Date: Sep. 22, 2022

(65) Prior Publication Data

US 2023/0243179 A1 Aug. 3, 2023

(51) Int. Cl.
*E04H 17/14* (2006.01)
*E04H 17/16* (2006.01)

(52) U.S. Cl.
CPC ..... *E04H 17/1439* (2013.01); *E04H 17/16* (2013.01)

(58) Field of Classification Search
CPC . E04H 17/24; E04H 17/1417; E04H 17/1447; E04H 17/1439; E04F 2011/1819; E04F 2011/1821; E04F 11/1842; E04F 11/1859; E04F 11/1817; F16G 11/12
See application file for complete search history.

(56) References Cited

U.S. PATENT DOCUMENTS

| | | | |
|---|---|---|---|
| 4,898,365 | A | 2/1990 | Conner |
| 6,341,764 | B1 | 1/2002 | Conner |
| 7,896,318 | B1 | 3/2011 | Gibbs |
| 8,899,555 | B2 | 12/2014 | Sherstad |
| 10,648,194 | B2 | 5/2020 | Lo |

(Continued)

FOREIGN PATENT DOCUMENTS

| | | | |
|---|---|---|---|
| CN | 202265787 | U | 6/2012 |
| CN | 202338078 | U | 7/2012 |

(Continued)

OTHER PUBLICATIONS

International Search Report issued in Intl. Appln. No. PCT/CN2021/081444 mailed Dec. 14, 2021.

(Continued)

*Primary Examiner* — Daniel J Wiley
(74) *Attorney, Agent, or Firm* — ROSSI, KIMMS & McDOWELL LLP

(57) ABSTRACT

A fence system includes a plurality of vertical members, at least one horizontal rail and a plurality of coupling members. A coupling member of the plurality of coupling members pivotally couples a vertical member of the plurality of vertical members and the at least one horizontal rail. The coupling member includes at least one pivoting feature configured to pivotally engage at least one of a vertical member front wall and a vertical member rear wall of the vertical member, at least one retaining feature configured to contact a sidewall of the vertical member, and at least one positioning feature configured to engage the at least one horizontal rail.

20 Claims, 22 Drawing Sheets

(56) References Cited

U.S. PATENT DOCUMENTS

| | | | |
|---|---|---|---|
| 2007/0170410 | A1 | 7/2007 | Devine |
| 2009/0065755 | A1 | 3/2009 | Sherstad |
| 2015/0300041 | A1 | 10/2015 | Feeko |
| 2019/0211579 | A1* | 7/2019 | Burt ..... E04H 17/1426 |

FOREIGN PATENT DOCUMENTS

| | | | |
|---|---|---|---|
| CN | 104878887 | A | 9/2015 |
| CN | 109594501 | A | 4/2019 |
| EP | 2299036 | A2 | 3/2011 |

OTHER PUBLICATIONS

Written Opinion issued in Intl. Appln. No. PCT/CN2021/081444 mailed Dec. 14, 2021.

* cited by examiner

ADJUSTABLE RACKING BARRIER SYSTEM

BACKGROUND

1. Field

Embodiments described herein relate generally to a barrier system and a method of assembly thereof, and more particularly to a barrier system including a plurality of vertical members, at least one horizontal rail and a plurality of coupling members for coupling each of the plurality of vertical members to the at least one horizontal rail and a method of assembly thereof.

2. Description of Related Art

Barrier systems formed from a plurality of vertical pickets coupled to at least one horizontal rail are known. Barrier systems which have adjustable racking for installation either on horizontal or sloping terrain are also known. Such adjustable racking barrier systems typically include pivoting connections between the vertical pickets and the horizontal rail. However, it may be difficult for a user to install such barrier systems, due to the use of pivoting connections which need to be screwed or otherwise welded to the vertical pickets or to the horizontal rail. User installation may also result in barrier systems which are aesthetically unpleasing when the pivoting connections are exposed. Hidden pivoting connections may be difficult for users to install. Additionally, barrier system which have pivoting connections may lack stability when assembled and when adjusting the racking thereof.

SUMMARY

In one embodiment, there is provided a fence system including a plurality of vertical members, at least one horizontal rail, and a plurality of coupling members. A coupling member of the plurality of coupling members pivotally couples a vertical member of the plurality of vertical members and the at least one horizontal rail. The coupling member includes at least one pivoting feature configured to pivotally engage at least one of a vertical member front wall and a vertical member rear wall of the vertical member, at least one retaining feature configured to contact a sidewall of the vertical member, and at least one positioning feature configured to engage the at least one horizontal rail.

In another embodiment, there is provided a method of assembling a fence system including a plurality of vertical members and at least one horizontal rail. The method involves engaging at least one positioning feature of a coupling member with a corresponding at least one positioning feature of the at least one horizontal rail. The method further involves pivotally engaging at least one pivoting feature of the coupling member with at least one of a vertical member front wall and a vertical member rear wall of a vertical member of the plurality of vertical members to pivotally couple the vertical member with the at least one horizontal rail. Engaging the at least one pivoting feature of the coupling member with the least one of the vertical member front and rear walls causes at least one retaining feature of the coupling member to contact a sidewall of the vertical member.

Other aspects and features of the present disclosure will become apparent to those ordinarily skilled in the art upon review of the following description of specific embodiments of the disclosure in conjunction with the accompanying Figures.

BRIEF DESCRIPTION OF THE DRAWINGS

In drawings which illustrate embodiments.

DETAILED DESCRIPTION

Figure 1:
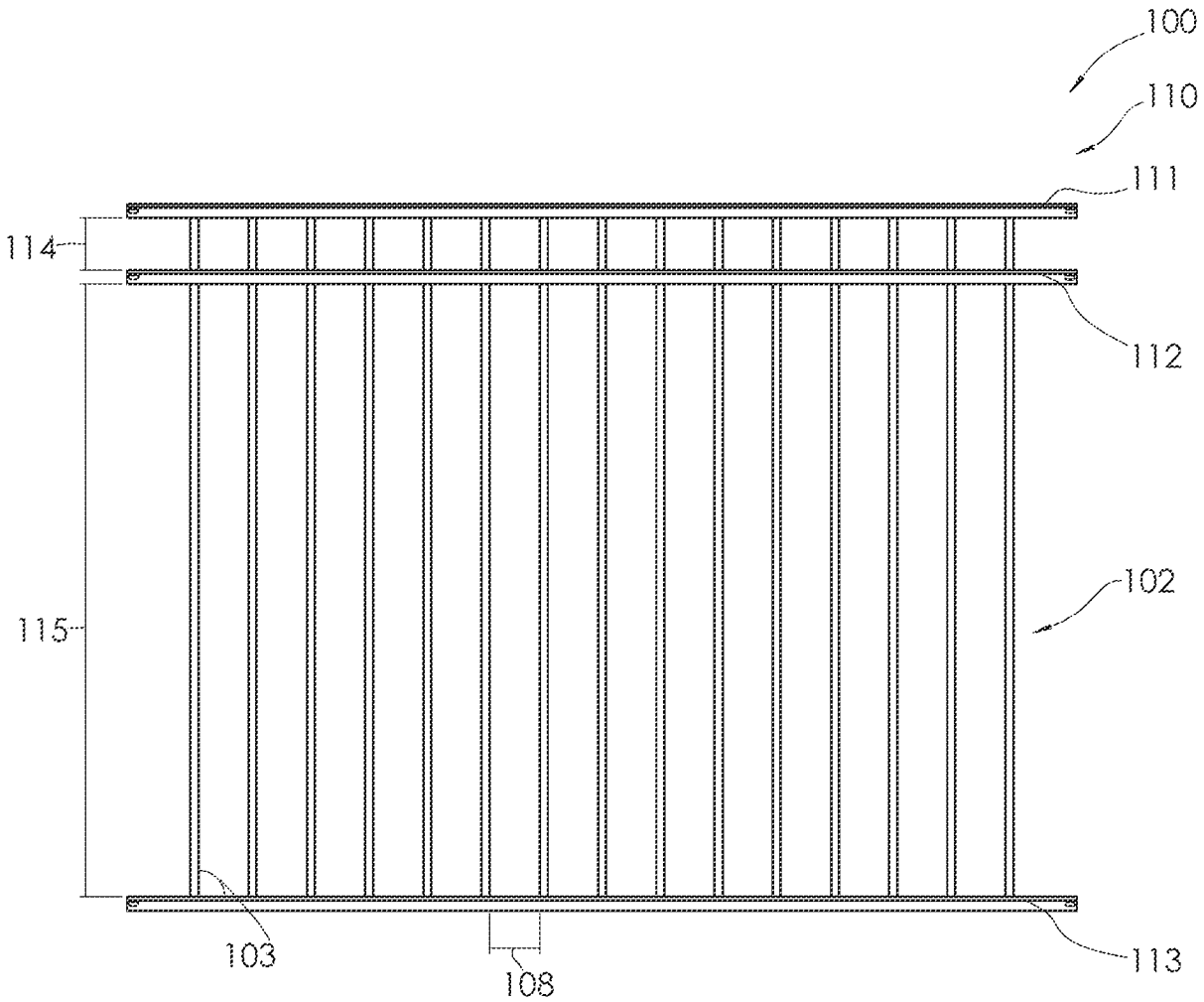
FIG. 1 is a front elevation view of a barrier system in accordance with one embodiment.

Referring to FIG. 1, a barrier system according to an embodiment is shown at 100. The barrier system 100 may be used to form a barrier, such as a fence or a balustrade. In this respect, a particular barrier or fence may be formed using a plurality of the barrier systems 100, wherein each barrier system 100 is supported by, and extended between, a pair of posts (not shown). The barrier system 100 includes a plurality of vertical members 102, at least one horizontal rail 110 and at least one coupling member 106 (shown in FIGS. 12-20) which pivotally couple one of the vertical members 102 to the at least one horizontal rail 110. As described in greater detail in association with FIGS. 12-20, the at least one coupling member 106 enables an angle 103 between the vertical members 102 and the at least one horizontal rail 110 to be adjusted after assembly (see angle 103' in FIG. 21 for example) by allowing the vertical members 102 to pivot relative to the at least one horizontal rail 110. As such, the barrier system 100 has adjustable racking to accommodate installation of the barrier system 100 over a variety of terrain features and over sloped terrain.

In the embodiment shown in FIG. 1, the barrier system 100 includes fifteen vertical members 102, which may be substantially identical to each other. Adjacent vertical members 102 are separated by a vertical member spacing distance 108. In the embodiment shown, the spacing distance 108 between each of the vertical members 102 is identical and is approximately 9.8 cm (3.85 inches). In other embodiments, the spacing distance 108 may be different and may vary depending on the desired visual effect and the desired security level for a particular barrier system. In yet other embodiments, the barrier system 100 may include fewer or more vertical members 102, the vertical members 102 of a particular barrier system 100 may not be identical to each other, and the spacing distance between different adjacent vertical members 102 may be different from each other (such that the vertical members 102 may of a particular barrier system 100 may be unevenly spaced).

The barrier system 100 also includes three horizontal rails 110, specifically an upper horizontal rail 111, a middle horizontal rail 112 and a lower horizontal rail 113. As described in greater detail in association with FIGS. 2-6, the middle and lower horizontal rails 112 and 113 may be substantially identical, while the upper horizontal rail 111 may have a different configuration. In the embodiment shown, the upper and middle horizontal rails 111 and 112 are separated by a first spacing distance 114, and the middle and lower horizontal rails 112 and 113 are separated by a second spacing distance 115. In the embodiment shown, the first spacing distance 114 is approximately 10.2 cm (4 inches) and the second spacing distance 115 is approximately 118 cm (48.5 inches). In other embodiments, the first and second spacing distances 114 and 115 may be different and may vary depending on the desired visual effect and the desired security level for a particular barrier system. In yet other embodiments, the barrier system 100 may include fewer or more horizontal rails 110 and the upper, middle and lower horizontal rails 111, 112 and 113 may all be different from each other or may be all substantially identical to each other.

Figure 2:
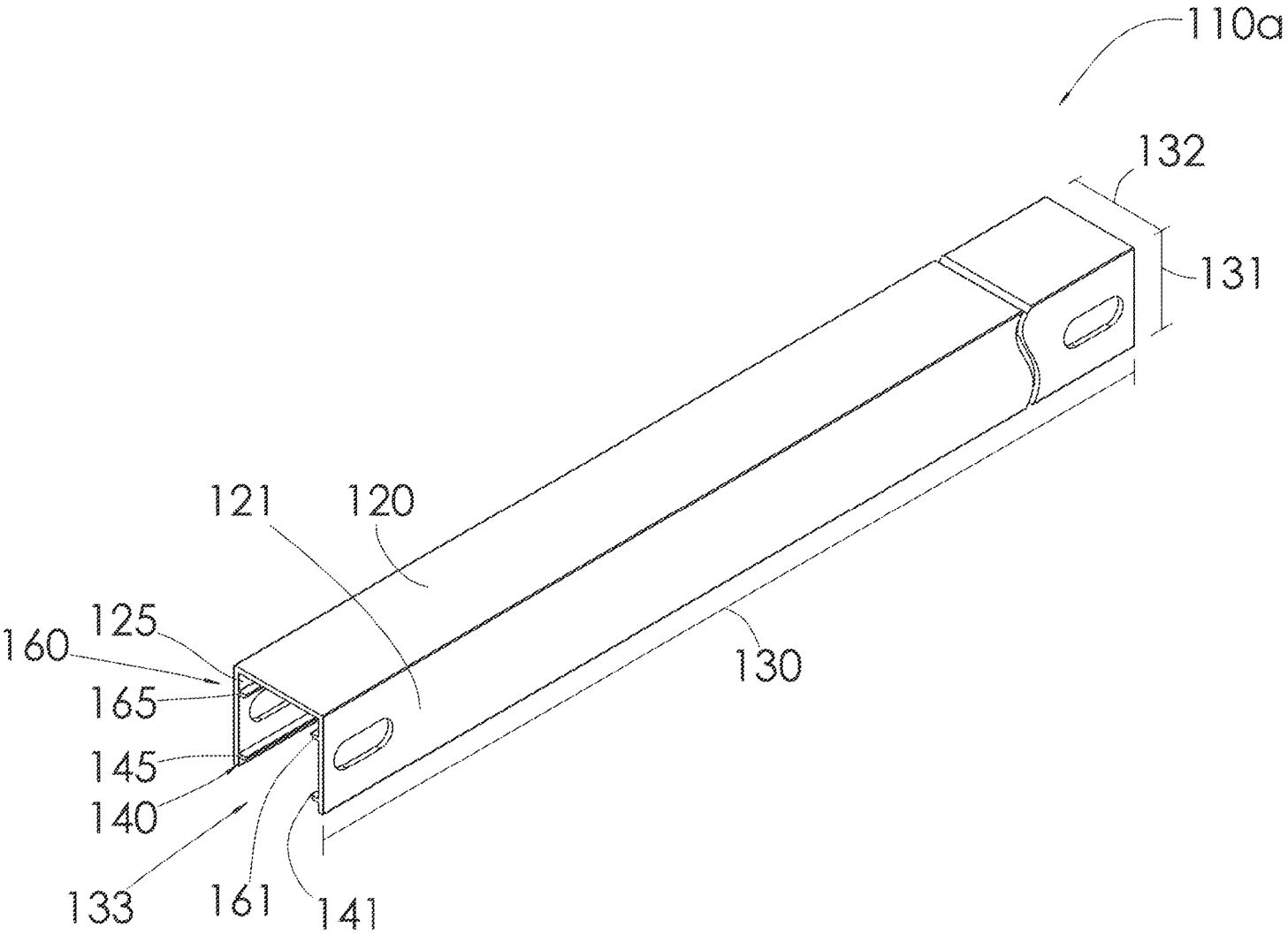
FIG. 2 is a front perspective view of a horizontal rail of the barrier system of FIG. 1 in accordance with one embodiment.
Figure 3:
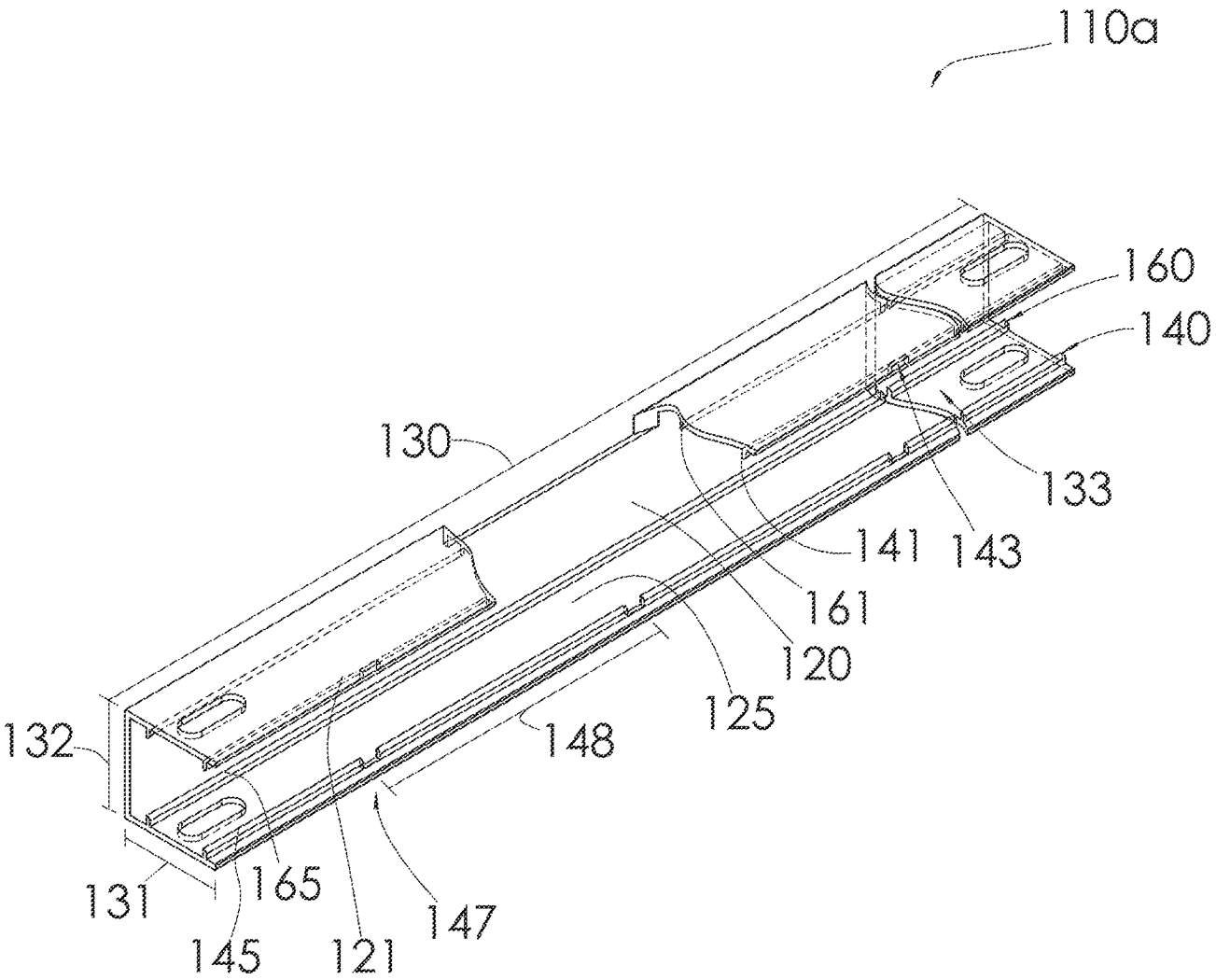
FIG. 3 is a rear perspective and partial sectional view of the horizontal rail of FIG. 2.
Figure 4:
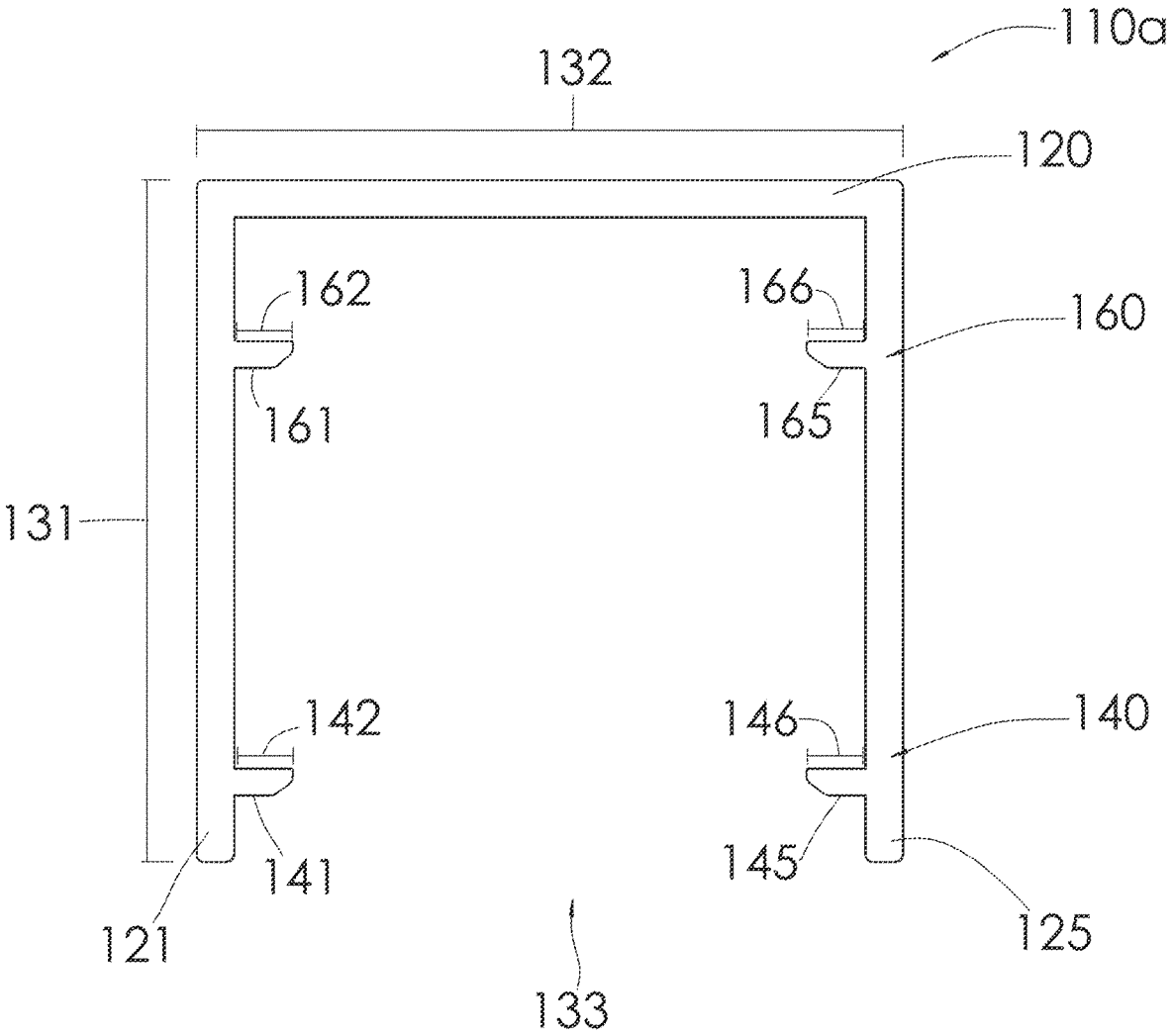
FIG. 4 is an end view of the horizontal rail of FIG. 2.

Referring now to FIGS. 2-4, an embodiment of the horizontal rail 110 is shown generally at **110*a*. The horizontal rail 110*a* may be formed from metal materials such as iron-based metals, aluminium-based metals, or steel-based metals, and may specifically be formed from 6063 aluminium alloy. The horizontal rail 110*a* may be manufactured using metal extrusion techniques. The horizontal rail 110*a* may also be surface treated to provide enhanced resistance to corrosion, such as a galvanizing treatment for iron-based metals or a polyester powder coating for aluminium-based metals for example. In other embodiments, the horizontal rail 110*a* may be formed from other materials, such as wood materials, plastic materials or composite materials, and may be formed from material that coordinates with the material of the vertical members 102**.

The horizontal rail **110*a* includes a top lateral wall 120, a front wall 121, and a rear wall 125. In the embodiment shown, the top wall 120 has a substantially flat outer surface which is also substantially continuous. Referring briefly to FIG. 1, in the barrier system 100 which includes a flat top (where the vertical members 102 do not protrude past the upper horizontal rail 111), the horizontal rail 110*a* having the substantially continuous top wall 120 may function as the upper horizontal rail 111**.

Referring back to FIGS. 2-4, the front and rear walls 121 and 125 extend from the top wall 120 and are opposed to each other. In the embodiment shown, similar to the top wall 120, the front and rear walls 121 and 125 also have a substantially flat outer surface. The top, front and rear walls 120, 121 and 125 provide the horizontal rail **110*a* with a generally rectangular cuboid configuration defining a C-shaped channel 133. In other embodiments, the horizontal rail 110*a* may have a different shape (such as an arched shape or curved shape for example) and the top, front and rear walls 120, 121 and 125** may have a different surface configuration (such as an arched surface, a rounded surface, a jagged surface or an irregular surface for example).

The horizontal rail **110*a* has a length 130, a height 131 and a width 132. In the embodiment shown, the length 130, the height 131 and the width 132 are, respectively, approximately 178 cm (70 inches), 2.9 cm (1.125 inches) and 2.8 cm (1.1 inches). In other embodiments, the length 130, the height 131, and the width 132 may be different and may vary depending on a desired size of the barrier system 100 and a desired number of vertical members 102 to be coupled to the horizontal rail 110*a*** for example.

The horizontal rail **110*a* includes at least one positioning feature 140 configured to engage with a corresponding at least one positioning feature of the at least one coupling member 106 (such as at least one positioning feature 400 of coupling member 106*a* shown in FIGS. 12-15 for example) to retain the at least one coupling member 106 within the channel 133 and to position the at least one coupling member 106 at specific locations along the length 130 (generally corresponding to locations where the vertical members 102 are to be coupled to the horizontal rail 110*a*) without any welding or other permanent attachment mechanisms between the coupling member 106 and the horizontal rail 110*a***.

Referring to FIGS. 2-4, in the embodiment shown, the at least one positioning feature 140 comprises a front ledge 141 extending from an inner surface of the front wall 121 and a rear ledge 145 extending from an inner surface of the rear wall 125. The front and rear ledges 141 and 145 may extend along the entire length 130 and may retain and position more than one coupling member 106 (such as a respective coupling member 106 associated with each vertical member 102 to be coupled to the horizontal rail **110*a* for example). The front and rear ledges 141 and 145 also extend from the front and rear walls 121 and 125 at a same location along the height 131 (best seen in FIG. 4), and are thus aligned with each other. The front and rear ledges 141 and 145 are shaped and dimensioned to sufficiently engage the at least one positioning feature of the coupling member 106 to prevent the coupling member 106 from falling out of the channel 133. In this respect, in the embodiment shown, the front and rear ledges 141 and 145 are substantially identical to each other and each have a generally polyhedron configuration. The front ledge 141 has an extension width 142 and the rear ledge 145 has an extension width 146, where the extension widths 142 and 146 are dimensioned to sufficiently engage the coupling member 106 as described above. Each of the front and rear ledges 141 and 145 include respective upward sloping end walls to achieve a necessary dimension of the extension widths 142 and 146 while reducing the amount of material required. In the embodiment shown, the extension widths 142 and 146 are both approximately 0.254 cm (0.1 inches). In other embodiments, the extension widths 142 and 146 may be different and may vary depending on dimensions of the at least one positioning feature of the coupling member 106 and relative dimensions of the coupling member 106 and the horizontal rail 110***a*.

In other embodiments, at least one positioning feature 140 may include front and rear ledges 141 and 145 which have different shapes (such as a rectangular cuboid, triangular prism, or cylinder for example), different dimensions and different end walls (such as flat end walls, downward sloping end walls, curved end walls or irregular end walls) than that described above. In yet other embodiments, the front ledge 141 may have a shape, dimensions and an end wall different from the rear ledge 145, which may be adapted to retain and position coupling members 106 that have corresponding front and rear positioning features which are shaped and dimensioned differently from each other. In yet other embodiments, the front and rear ledges 141 and 145 may extend at different locations along the height 131 and may be unaligned, which may be adapted to engage coupling members 106 that have corresponding unaligned front and rear positioning features. In other embodiments, the front and rear ledges 141 and 145 may only extend along a portion of the length 130.

Referring to FIG. 3, in the embodiment shown, the at least one positioning feature 140 further includes a plurality of front recesses 143 formed in the front ledge 141 and a plurality of rear recesses 147 formed in the rear ledge 145. The front and rear recesses 143 and 147 are configured to receive corresponding front and rear positioning projections of the at least one coupling member 106 (such as front and rear positioning projections 411 and 415 of the coupling member 106*a* shown in FIGS. 12-15 for example) to position the at least one coupling member 106 at the specific locations along the length 130 without any welding or any other permanent attachment mechanisms between the at least one coupling member 106 and the horizontal rail 110*a*.

In the embodiment shown, the at least one positioning feature 140 includes both a front recess 143 and rear recess 147 for retaining and positioning a single coupling member 106, which form a pair of recesses. Additionally, the pair of front and rear recesses 143 and 147 are formed in the front and rear ledges 141 and 145 at a same location along the length 130, and are thus also aligned with each other. In the embodiment shown, the front and rear ledges 141 and 145 include one pair of aligned front and rear recesses 143 and 147 for a respective coupling member 106 associated with each vertical member 102 to be coupled to the horizontal rail 110*a*. Thus, the number of front recesses 143 formed in the front ledge 141 and the number of rear recesses 147 formed in the rear ledge 145 of a particular horizontal rail 110*a* may vary depending on the number of vertical members 102 in the barrier system 100. Adjacent pairs of front and rear recesses 143 and 147 may be spaced apart by a spacing distance 148 (seen in FIG. 3). The spacing distance 148 may correspond to the desired spacing distance 108 (shown in FIG. 1) between adjacent vertical members 102. In the embodiment shown, the spacing distance 148 is approximately 11.2 cm (4.4 inches). In other embodiments, the spacing distance 148 may be different and may vary depending on the desired spacing distance 108 between adjacent vertical members 102.

In the embodiment shown, the paired front and rear recesses 143 and 147 are substantially identical to each other and have a generally rectangular cuboid configuration. In this respect, each of the front and rear recesses 143 and 147 may have a width that extends the entire extension width 142 and 146 of the front and rear ledges 141 and 145 and a length dimensioned to receive the corresponding front and rear positioning projections of the coupling member 106. In the embodiment shown, each of the front and rear recesses 143 and 147 has a width of approximately 0.254 cm (0.1 inches) and a length of approximately 0.635 cm (0.25 inches). In other embodiments, the width and length of the front and rear recesses 143 and 147 may be different and may vary depending on dimensions of the corresponding pair of front and rear positioning projections of the coupling member 106 and also dimensions of the front and rear ledges 141 and 145.

In other embodiments, the at least one positioning feature 140 may include more than one pair of front and rear recesses 143 and 147 for retaining and positioning a single coupling member 106, which may be adapted to engage coupling members 106 with more than one corresponding pair of the front and rear positioning projections. In yet other embodiments, the at least one positioning feature 140 may only include the front recesses 143 formed in the front ledge 141 (with no rear recesses 147 formed in the rear ledge 145) or may only include the rear recesses 147 formed in the rear ledge 145 (with no front recesses 143 formed in the front ledge 141). In yet other embodiments, the front and rear ledges 141 and 145 may both include front and rear recesses 143 and 147, but a particular front recess 143 may not be paired with any rear recess 147 and a particular rear recess 147 and may not be paired with any front recess 143. Such embodiments may be adapted to retain and position coupling members 106 having only a front positioning projection (with no rear positioning projection) or only a rear positioning projection (with no front positioning projection). In yet other embodiments, a particular front recess 143 may be paired with more than one rear recess 147 to retain and position a single coupling member 106 or a particular rear recess 147 may be paired with more than one front recess 143 to retain and position a single coupling member 106. Such embodiments may be adapted to retain and position coupling members 106 having only one front positioning projection but more than one rear positioning projection or only one rear positioning projection but more than one front positioning projection.

In other embodiments, the front and rear recesses 143 and 147 may have different shapes (such as a polyhedron, triangular prism, or cylinder for example) and different dimensions than that described above. In yet other embodiments, a front recess 143 may have a shape and dimensions different from a paired rear recess 147, which may be adapted to retain and position coupling members 106 having a corresponding pair of front and rear positioning projections also shaped and dimensioned differently from each other. In yet other embodiments, certain front recesses 143 may have a shape and dimensions different from other front recesses 143 and/or certain rear recesses 147 may have a shape and dimensions different from other rear recesses 147. Such embodiments may be adapted to retain and position different types of coupling members 106 along the length 130 of a single horizontal rail 110*a*. In yet other embodiments, a pair of front and rear recesses 143 and 147 for engaging and positioning a single coupling member 106 may be located at different locations along the length 130 and may not be aligned with each other, which may be adapted to engage coupling members 106 having a pair of correspondingly unaligned front and rear positioning projections. In yet other embodiments, the width of the front and rear recesses 143 and 147 may be greater than the entire extension width 142 and 146 of the front and rear ledges 141 and 145 and may further include a divot or recess formed in the inner surface of the front and rear walls 121 and 125 for example, which may be adapted to more securely retain and position the coupling members 106. In yet other embodiments, the spacing distance 148 between different adjacent pairs of the front and rear recesses 143 and 147 may be different from each other, which may be adapted to form barrier systems having a varying spacing distance 108 between adjacent vertical members 102.

The horizontal rail 110*a* may further include at least one contacting feature 160 configured to contact the coupling member 106 retained and positioned by the at least one positioning feature 140 to reduce movement (particularly lateral movement along the width 132) of the coupling member 106 within the channel 133.

In the embodiment shown in FIGS. 2-4, the at least one contacting feature 160 comprises a front rib 161 extending from the inner surface of the front wall 121 at a location along the height 131 above the front ledge 141 and a rear rib 165 extending from the inner surface of the rear wall 125 at a location along the height 131 above the rear ledge 145. The front and rear ribs 161 and 165 may extend along the entire length 130 of the horizontal rail 110*a* and may contact more than one coupling member 106. The front and rear ribs 161 and 165 may extend from the front and rear walls 121 and 125 at a same location along the height 131 (best seen in FIG. 4), and are thus aligned with each other.

The front and rear ribs 161 and 165 may be similar to the front and rear ledges 141 and 145. In this respect, the front and rear ribs 161 and 165 are also substantially identical to each other, each also have a generally polyhedron configuration, the front rib 161 also has an extension width 162, and the rear rib 165 also has an extension width 166. The front and rear ribs 161 and 165 may be separated from the front and rear ledges 141 and 145 by a separation distance. The separation distance and the extension widths 162 and 166 may be dimensioned such that, when the coupling member 106 is retained and positioned by the front and rear ledges 141 and 145, the front and rear ribs 161 and 165 are positioned and dimensioned to contact a portion of the coupling member 106 to reduce movement thereof. In the embodiment shown, the separation distance between the front rib and ledge 161 and 141 and between the rear rib and ledge 165 and 145 are both approximately 1.65 cm (0.65 inches) and the extension widths 162 and 166 are both approximately 0.254 cm (0.1 inches). In other embodiments, the separation distances and the extension widths 162 and 166 may be different and may vary depending on dimensions of the coupling member 106 and the horizontal rail 110*a*.

In other embodiments, at least one contacting feature 160 may include front and rear ribs 161 and 165 which have different shapes (such as a rectangular cuboid, triangular prism, or cylinder for example), different dimensions and different end walls (such as flat end walls, downward sloping end walls, curved end walls or irregular end walls) than that described above. In yet other embodiments, the front rib 161 may have a shape, dimensions and end walls different from the rear rib 165, which may be adapted to contact coupling members 106 having front and rear walls also shaped and dimensioned differently from each other. In other embodiments, the front and rear ribs 161 and 165 may extend at different locations along the height 131 and may be unaligned or the separation distance between the front rib and ledge 161 and 141 may be different from the separation distance between the rear rib and ledge 165 and 145. In other embodiments, the front and rear ribs 161 and 165 may only extend along a portion of the length 130. In other embodiments, horizontal rail 110*a* may not include the at least one contacting feature 160 (may only include the at least one positioning feature 140 for example).

Figure 5:
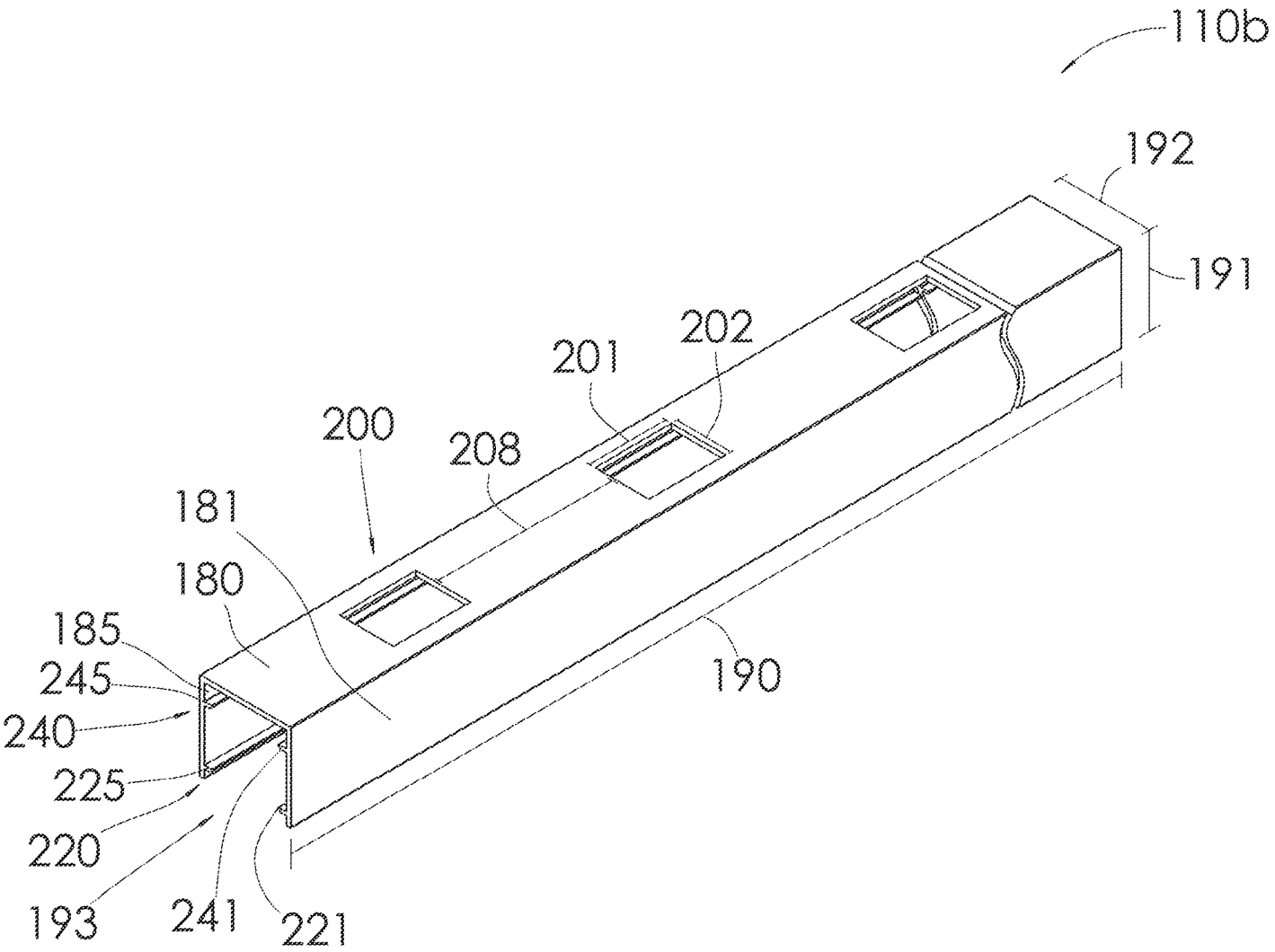
FIG. 5 is a front perspective view of a horizontal rail of the barrier system of FIG. 1 in accordance with another embodiment.
Figure 6:
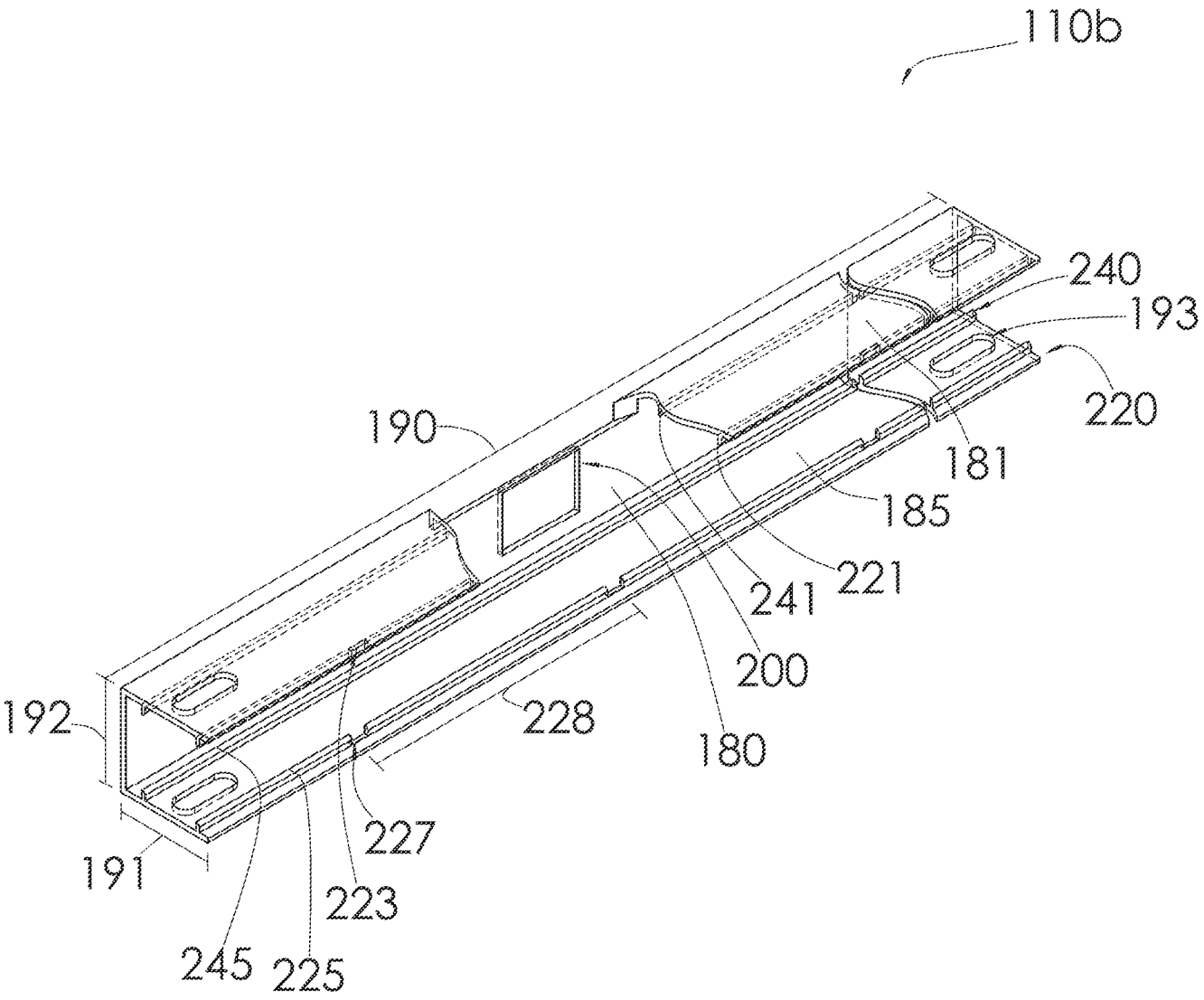
FIG. 6 is a rear perspective and partial sectional view of the horizontal rail of FIG. 5.

Referring now to FIGS. 5 and 6, another embodiment of the horizontal rail 110 is shown generally at 110*b*. Similar to the horizontal rail 110*a*, the horizontal rail 110*b* may also be formed from metal materials (such as 6063 aluminium alloy) and may also be surface treated.

Figure 7:
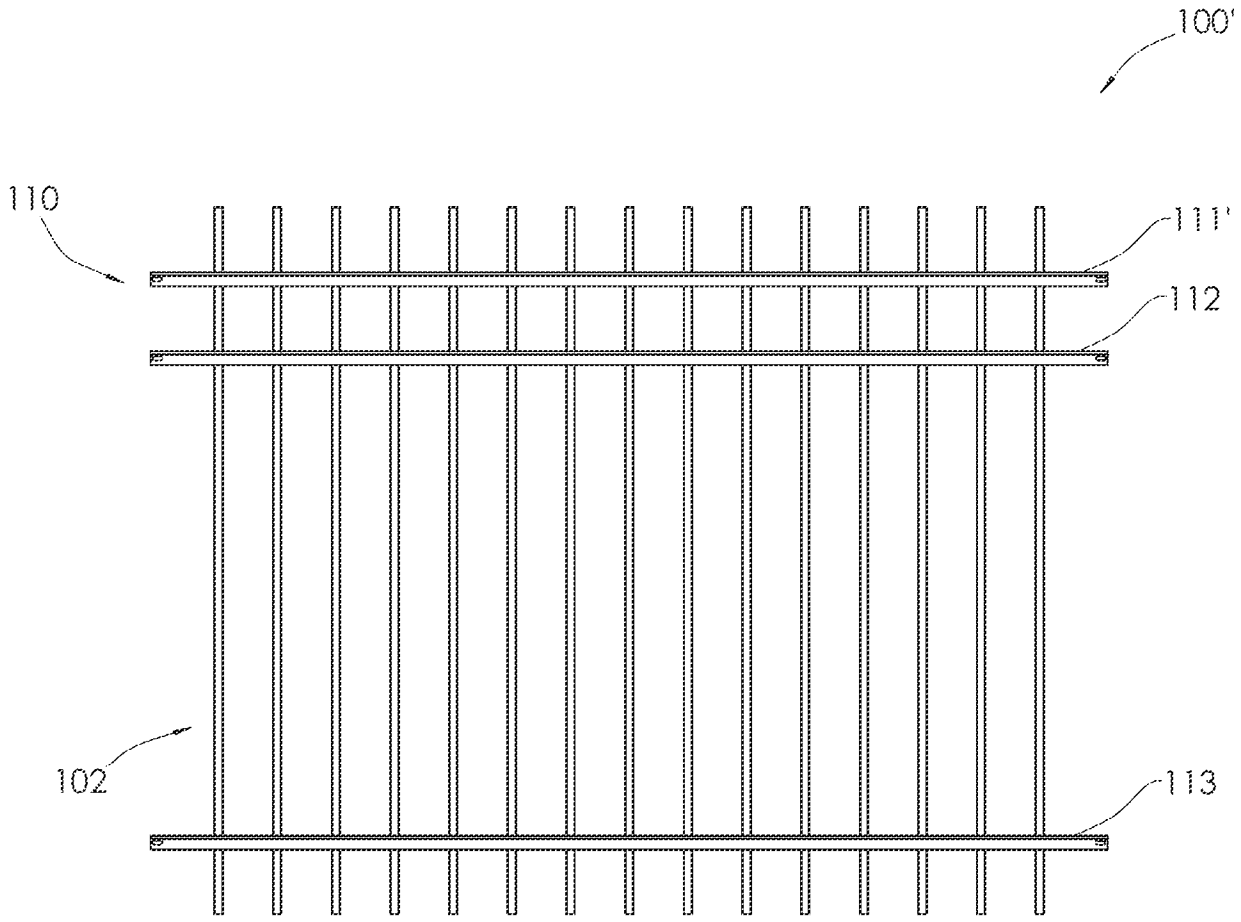
FIG. 7 is a front elevation view of a barrier system in accordance with another embodiment.

The horizontal rail 110*b* includes a top lateral wall 180, a front wall 181 and a rear wall 185. In the embodiment shown, the top wall 180 is substantially flat and includes a plurality of apertures 200. Each of the apertures 200 are configured to receive and retain one of the vertical members 102 (shown in FIG. 1) at a specific location along a length 190 of the horizontal rail 110*b*. Referring briefly to FIG. 1, in the barrier system 100 that includes the flat top, the horizontal rail 110*b* including the apertures 200 in the top wall 180 may function as the middle and lower horizontal rails 112 and 113. Referring briefly to FIG. 7, in a barrier system 100' that includes an extend top (where the vertical members 102 do protrude past an upper horizontal rail 111'), the horizontal rail 110*b* may function as each of the upper, middle, and lower horizontal rails 111', 112 and 113.

Referring back to FIGS. 5 and 6, in the embodiment shown, the horizontal rail 110*b* may include a respective aperture 200 for each vertical member 102 to be coupled to the horizontal rail 110*b*. Thus, the number of apertures 200 formed in the top wall 180 of a particular horizontal rail 110*b* may vary depending on the number of vertical members 102 in a particular barrier system 100. Adjacent apertures 200 may be spaced apart by a spacing distance 208. The spacing distance 208 between adjacent apertures 200 may correspond to the desired spacing distance 108 (shown in FIG. 1) between adjacent vertical members 102. In the embodiment shown, the spacing distance 208 is approximately 8.9 cm (3.5 inch). In other embodiments, the spacing distances 208 may be different and may vary depending on the desired spacing distance 108.

The apertures 200 may be shaped and dimensioned to receive the vertical members 102. In the embodiment shown, the apertures 200 are substantially identical to each other and have a generally rectangular cross-section to receive and retain correspondingly identical vertical members 102 having a rectangular cross-section (such as vertical member 102*a* shown in FIGS. 8 and 9 for example). Each of the apertures 200 have an aperture length 201 and an aperture width 202 (shown in FIG. 5). The aperture length 201 and aperture width 202 may be larger than, respectively, a length and a width of the vertical members 102 (such as length 270 and width 272 of the vertical member 102*a* shown in FIGS. 8 and 9 for example). The aperture length 201 may further be dimensioned to allow the vertical member 102 to pivot relative to the horizontal rail 110*b* and may be significantly larger than the length of the vertical members 102.

In other embodiments, the top wall 180 may include more or fewer apertures 200 depending on the number of vertical members 102 to be coupled to the horizontal rail 110*b*. In yet other embodiments, the apertures 200 may have different shapes (such as a triangular cross-section, a circular cross-section, or a different polygonal shape cross-section) and different dimensions, which may be adapted to receive and retain vertical members 102 having correspondingly different shapes and dimensions (such as a circular cross-section of vertical member 102*b* shown in FIG. 10 and a triangular cross-section of vertical member 102*c* shown in FIG. 11 for example). In yet other embodiments, certain apertures 200 may have a shape and dimensions different from other apertures 200, which may be adapted to receive and retain different types of vertical members 102 with a single horizontal rail 110*b*. In yet other embodiments, the spacing distance 208 between different adjacent apertures 200 may be different from each other, which be adapted to form barrier systems having varying spacing distances 108 between adjacent vertical members 102.

The front and rear walls 181 and 185 both extend from the top wall 180 opposed to each other. The top, front and rear walls 180, 181 and 185 provide the horizontal rail 110*b* with a generally rectangular cuboid configuration defining a C-shaped channel 193. In other embodiments, the horizontal rail 110*b* may have a different shape (such as an arched shape or curved shape for example) and the top, front and rear walls 180, 181 and 185 may have a different surface configuration (such as an arched surface, a rounded surface, a jagged surface or an irregular surface for example).

The horizontal rail 110*b* also has the length 190, a height 191 and a width 192. In the embodiment shown, the length 190, the height 191 and the width 192 are, respectively, 178 cm (70 inches), 2.86 cm (1.125 inches) and 2.79 cm (1.1 inches). In other embodiments, the length 190, the height 191 and the width 192 may be different and may vary depending on a desired size of the barrier system 100 and a desired number of vertical members 102 to be coupled to the horizontal rail 110*b*.

The horizontal rail 110*b* includes at least one positioning feature 220 configured to engage with corresponding at least one positioning feature of the at least one coupling member 106 (such as at least one positioning feature 600 of the coupling member 106*b* shown in FIGS. 16-19) to retain the at least one coupling member 106 within the channel 193 and to position the at least one coupling member 106 at specific locations along the length 190 without any welding or other permanent attachment mechanisms between the coupling member 106 and the horizontal rail 110*b*.

The at least one positioning feature 220 may be similar to the at least one positioning feature 140 of the horizontal rail 110*a* (shown in FIGS. 2-4). In this respect, in the embodiment shown, the at least one positioning feature 220 also includes a front ledge 221 extending from an inner surface of the front wall 181 and a rear ledge 225 extending from an inner surface of the rear wall 185. The front and rear ledges 221 and 225 may be similar to the front and rear ledges 141 and 145 of the horizontal rail 110*a* (shown in FIGS. 2-4). In this respect, in the embodiment shown, the front and rear ledges 221 and 225 also extend along the entire length 190 and may retain and position more than one coupling member 106 (such as a respective coupling member 106 associated with each vertical member 102 to be coupled to the horizontal rail 110*b* for example). The front and rear ledges 221 and 225 also extend from the front and rear walls 181 and 185 at a same location along the height 191, and are thus aligned with each other. The front and rear ledges 221 and 225 are also shaped and have extension widths dimensioned to sufficiently engage the at least one positioning feature of the coupling member 106 to prevent the coupling member 106 from falling out of the channel 193.

In the embodiment shown, the extension widths of the front and rear ledges 221 and 225 are both approximately 0.254 cm (0.1 inches). In other embodiments, the extension widths of the front and rear ledges 221 and 225 may be different and may vary depending on dimensions of the at least one positioning feature of the coupling member 106 and dimensions of the coupling member 106 and horizontal rail 110*b*.

In other embodiments, the at least one positioning feature 220 may: (1) include front and rear ledges 221 and 225 which have different shapes and different dimensions than that described above; (2) include a front ledge 221 having a shape and dimensions different from a rear ledge 225; (3) include unaligned front and rear ledges 221 and 225; and (4) include front and rear ledges 221 and 225 which only extend a portion of the length 190, all of the above similar to alternative embodiments described in association with the at least one positioning feature 140 of the horizontal rail 110*a*.

Referring now to FIG. 6, the at least one positioning feature 220 further includes a plurality of front recesses 223 formed in the front ledge 221 and a plurality of rear recesses 227 formed in the rear ledge 225. The front and rear recesses 223 and 227 are configured to receive corresponding front and rear positioning projections of the at least one coupling member 106 (such as front and rear positioning projections 611 and 615 of the coupling member 106*b* shown in FIGS. 16-19 for example) to position the at least one coupling member 106 at the specific locations along the length 190 without any welding or other permanent attachment mechanisms between the at least one coupling member 106 and the horizontal rail 110*b*.

The front and rear recesses 223 and 227 may be similar to the front and rear recesses 143 and 147 of the horizontal rail 110*a* (shown in FIG. 3). In this respect, in the embodiment shown, the front and rear ledges 221 and 225 also includes a pair of front and rear recesses 223 and 227 to position a single coupling member 106, and the pair of front and rear recesses 223 and 227 are also formed in the front and rear ledges 221 and 225 at a same location along the length 190 and are thus also aligned with each other. One pair of aligned front and rear recesses 223 and 227 are for retaining and positioning a respective coupling member 106 associated with each vertical member 102 to be coupled to the horizontal rail 110*b*. Thus, the number of front recesses 223 formed in the front ledge 221 and the number of rear recesses 227 formed in the rear ledge 225 of a particular horizontal rail 110*b* may vary depending on the number of vertical members 102 in the barrier system 100. Adjacent pairs of front and rear recesses 223 and 227 may be spaced apart by a spacing distance 228. The spacing distance 228 may correspond to the desired spacing distance 108 (shown in FIG. 1) between adjacent vertical members 102. The spacing distance 228 may further correspond to the spacing distance 208 between adjacent apertures 200 (shown in FIG. 5) in the top wall 180, as the apertures 200 and the pairs of front and rear recesses 223 and 227 may cooperate together to retain and position the coupling members 106 and the vertical members 102 at the specific locations along the length 190. In the embodiment shown, the spacing distance 228 between adjacent pairs of front and rear recesses 223 and 227 are dimensioned to position the pair of front and rear recesses 223 and 227 at approximately a middle of the aperture length 201 (shown in FIG. 5) of a corresponding aperture 200. In the embodiment shown, the spacing distance 228 is approximately 11.2 cm (4.4 inches). In other embodiments, the spacing distance 228 may be different and may vary depending on the desired spacing distance 108 between adjacent vertical members 102 of a particular barrier system. The paired front and rear recesses 223 and 227 are also substantially identical to each other, have a generally rectangular cuboid configuration, a width that extends the entire extension width of the front and rear ledges 221 and 225, and a length dimensioned to receive the corresponding front and rear positioning projections of the coupling member 106. In the embodiment shown, each of the front and rear recesses 223 and 227 has a width of approximately 0.254 cm (0.1 inches) and a length of approximately 0.635 cm (0.25 inches). In other embodiments, the width and length of the front and rear recesses 223 and 227 may be different and may vary depending on dimensions of the corresponding front and rear positioning projections of the coupling member 106 and also dimensions of the front and rear ledges 221 and 225.

In other embodiments, the at least one positioning feature 220 may: (1) include more than one front recess 223 and/or more than one rear recess 227 for engaging a single coupling member 106; (2) only include the front recesses 223 (with no rear recesses 227 formed in the rear ledge 225) or only include the rear recesses 227 (with no front recesses 223 formed in the front ledge 221); (3) only include unpaired front and rear recesses 223 and 227; (4) include one front recess 223 paired with more than one rear recess 227 and/or include one rear recess 227 paired with more than one front recess 223 to engage a single coupling member 106; (5) include front and rear recesses 223 and 227 which have different shapes and different dimensions than that described above; (6) include front recesses 223 which have shapes and dimensions different from other front recesses and/or rear recesses 227 which have shapes and dimensions different from other rear recesses; (7) include front recesses 223 which have shapes and dimensions different from a paired rear recess 227; (8) include front and rear recesses 223 and 227 with extension widths greater than the entire extension width of the front and rear ledges 221 and 225; (9) include unaligned pairs of front and rear recesses 223 and 227; and (10) include different spacing distances 228 between different adjacent pairs of front and rear recesses 223 and 227, all of the above similar to alternative embodiments described in association with the front and rear recesses 143 and 147 of the horizontal rail 110*a*.

The horizontal rail 110*b* may further include at least one contacting feature 240 configured to contact the coupling member 106 retained and positioned by the at least one positioning feature 220 to reduce movement (particularly lateral movement along the width 192) of the coupling member 106 within the channel 193.

The at least one contacting feature 240 may be similar to the at least one contacting feature 160 of the horizontal rail 110*a* (shown in FIGS. 2-4). In this respect, in the embodiment shown, the at least one contacting feature 240 also comprises a front rib 241 extending from the inner surface of the front wall 181 at a location along the height 191 above the front ledge 221 and a rear rib 245 extending from the inner surface of the rear wall 185 at a location along the height 191 above the rear ledge 225. The front and rear ribs 241 and 245 may be similar to the front and rear ribs 161 and 165 (shown in FIGS. 2-4) of the horizontal rail 110*a*. In this respect, in the embodiment shown the front and rear ribs 241 and 245 also extend along the entire length 190 to contact more than one coupling member 106, are also aligned with each other along the height 191, also extend above, respectively, the front and rear ledges 221 and 225 by a separation distance, and each also have respective extension widths. The separation distance and the extension widths are dimensioned to enable the front and rear ribs 241 and 245 to contact a portion of the coupling member 106 retained and positioned by the front and rear ledges 221 and 225. In the embodiment shown, the separation distance between the front rib and ledge 241 and 221 and between the rear rib and ledge 245 and 225 are both approximately 1.65 cm (0.65 inches) and the extension width of the front and rear ribs 241 and 245 are both approximately 0.254 cm (0.1 inches). In other embodiments, the separation distances between the front rib and ledge 241 and 221 and between the rear rib and ledge 245 and 225 and the extension widths of the front and rear ribs 241 and 245 may be different may vary depending on dimensions of the coupling member 106 and the horizontal rail 110*b*.

In other embodiments, the at least one contacting feature 240 of the horizontal rail 110*b* may: (1) include front and rear ribs 241 and 245 which have different shapes and different dimensions than that described above; (2) include a front rib 241 which has a shape and dimensions different from the rear rib 245; (3) include unaligned front and rear ribs 241 and 245; (4) include a separation distance between the front rib and ledge 241 and 221 which is different than a separation distance between the rear rib and ledge 225 and 245; and (5) include front and rear ribs 241 and 245 which only extend a portion of the length 190, all of the above similar to alternative embodiments described in association with the at least one contacting feature 160 of the horizontal rail 110*a*. In yet other embodiments, the horizontal rail 110*b* may not include the least one contacting feature 240 (may only include the at least one positioning feature 220 for example).

Figure 8:
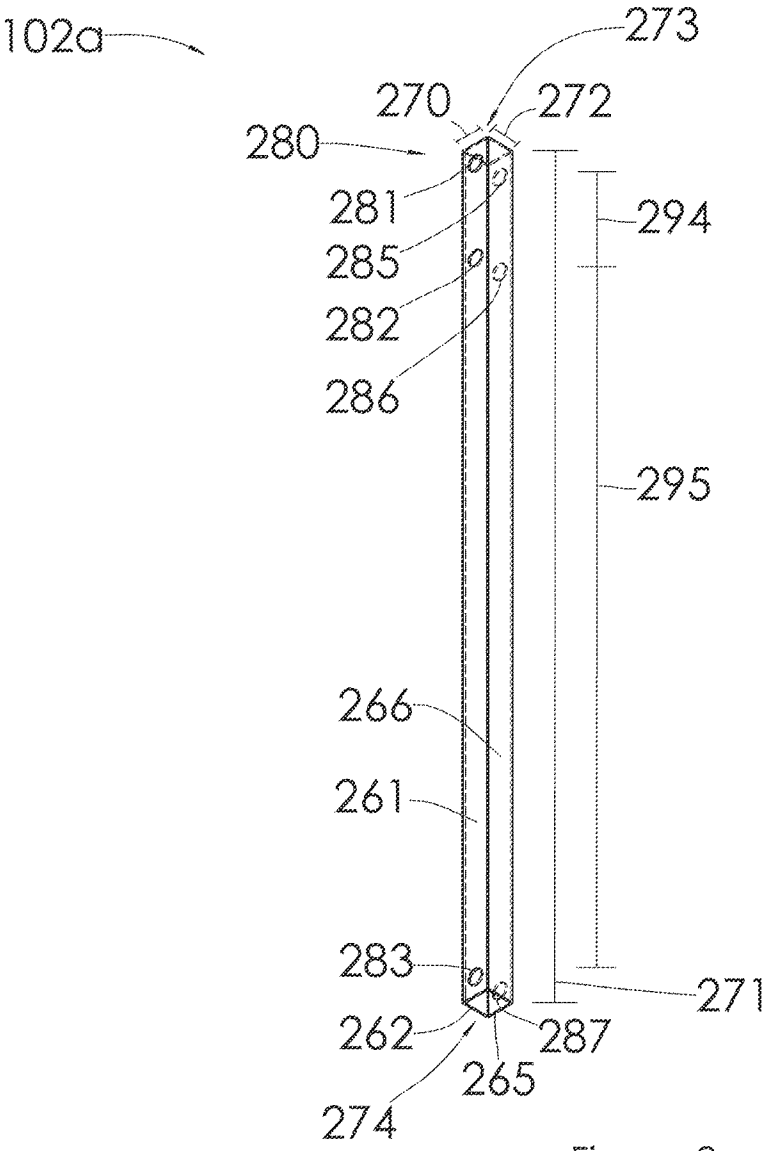
FIG. 8 is a front perspective view of a vertical member of the barrier system of FIG. 1 in accordance with one embodiment.
Figure 9:
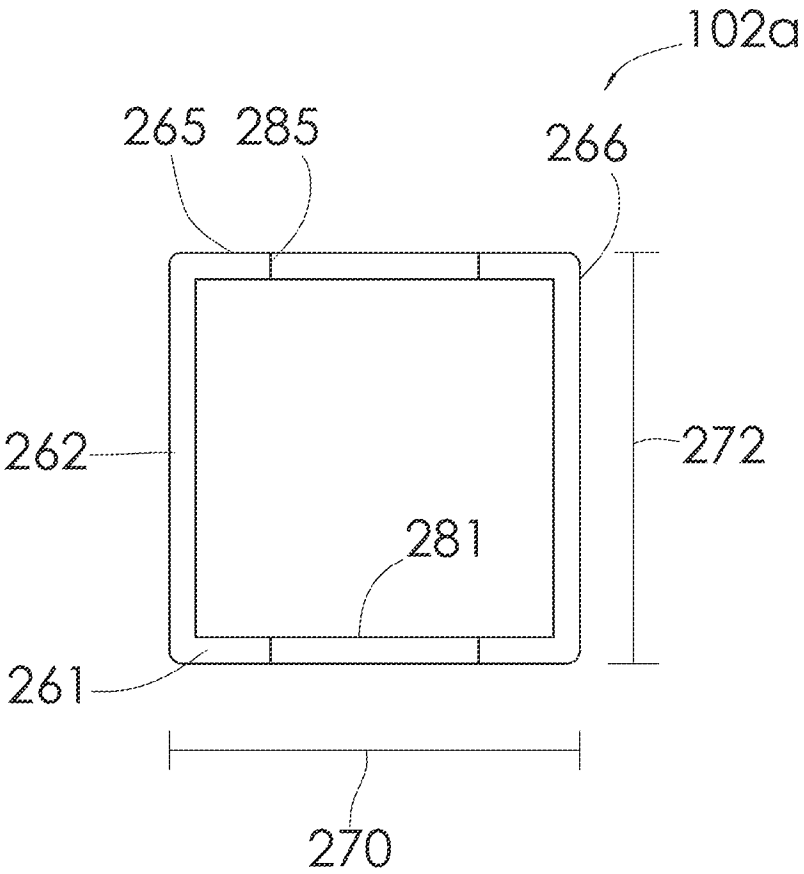
FIG. 9 is a sectional view of the vertical member of the FIG. 8.

Referring now to FIGS. 8 and 9, an embodiment of the vertical member 102 is shown generally at 102*a*. The vertical member 102*a* may function as any of the vertical members 102 (shown in FIG. 1). In the embodiment shown, the vertical member 102*a* has a hollow configuration. In other embodiments, the vertical member 102*a* may instead have a solid configuration (not shown). The vertical members 102 may be formed from metal materials such as iron-based metals, aluminium-based metals or steel-based metals for example and may specifically be formed from 6063 aluminium alloy. In the embodiment shown, the hollow configuration of the vertical member 102*a* may be formed by rolling a sheet of the metal material into a tubular configuration. In embodiments where the vertical member 102*a* has the solid configuration, the vertical member 102*a* may instead be formed from solid bar stock of the metal material. The vertical member 102*a* may be surface treated to provide enhanced resistance to corrosion, such a galvanizing treatment for iron-based metals or a polyester powder coating for aluminium-based metals for example. In other embodiments, the vertical members 102*a* may be formed from other materials, such as wood materials or plastic materials or composite materials, and may be formed from a material that coordinate with the material of the at least one horizontal rail 110.

The vertical member 102*a* is shaped and dimensioned to be received within: (1) a channel of the at least one horizontal rail 110 (such as the channel 133 of horizontal rail 110*a* shown in FIGS. 2-4 and the channel 193 of horizontal rail 110*b* shown in FIGS. 5 and 6 for example); (2) an aperture in a top wall of the at least one horizontal rail 110 (such as the apertures 200 of the horizontal rail 110*b* shown in FIGS. 5 and 6 for example); and (3) and an aperture of the at least one coupling member 106 (such as aperture 343 of the coupling member 106*a* shown in FIGS. 12-15 and aperture 543 of the coupling member 106*b* shown in FIGS. 16-19 for example).

In the embodiment shown, the vertical member 102*a* has a rectangular cuboid configuration and a rectangular cross-section formed from a front wall 261, a rear wall 265, a first sidewall 262 and a second sidewall 266. The vertical member 102*a* also the length 270, a height 271 extending between an upper end 273 and a lower end 274 and the width 272. For the vertical member 102*a* to be received within a channel of the at least one horizontal rail 110, the width 272 is less than a width of the at least one horizontal rail 110 (such as the width 132 of the horizontal rail 110*a* shown in FIGS. 2-4 and the width 192 of the horizontal rail 110*b* shown in FIGS. 5 and 6 for example). For the vertical member 102*a* to be received in an aperture in the top wall of the at least one horizontal rail 110, the length 270 and the width 272 are less than, respectively, an aperture length and an aperture width of the aperture (such as the aperture length 201 and the aperture width 202 of the apertures 200 shown in FIG. 5 for example). Additionally, for the vertical member 102*a* to be received in an aperture of the at least one coupling member 106, the length 270 and the width 272 are less than, respectively, an aperture length and an aperture width of the aperture (such as aperture length 395 and aperture width 396 of the aperture 343 of the coupling member 106*a* shown in FIGS. 12-15 or aperture length 595 and aperture width 596 of the aperture 543 of the coupling member 106*b* shown in FIGS. 16-19 for example). In the embodiment shown, the length 270, the height 271 and the width 272 are, respectively, approximately 1.6 cm (0.625 inches), 136 cm (53.5 inches) and 1.6 cm (0.625 inches). In other embodiments, the length 270, that height 271 and the width 272 may be different and may vary depending on dimensions of the at least one horizontal rail 110, dimensions of the at least one coupling member 106 and desired dimensions of the barrier system 100.

The vertical member 102*a* includes at least one pivoting feature 280 configured to pivotally engage at least one corresponding pivoting feature of the at least one coupling member 106 (such at least one pivoting feature 430 of the coupling member 106*a* shown in FIGS. 12-15 and at least one pivoting feature 630 of the coupling member 106*b* shown in FIGS. 16-19 for example) to pivotally couple the vertical member 102*a* with the at least one coupling member 106 and to position the at least one coupling member 106 at specific locations along the height 271 (generally corresponding to locations where the vertical member 102*a* is to be coupled to the at least one horizontal rail 110) without any welding or other permanent attachment mechanisms between the vertical member 102*a* and the at least one coupling member 106.

Referring to FIGS. 8 and 9, in the embodiment shown, the at least one pivoting feature 280 includes an upper front aperture 281, a middle front aperture 282 and a lower front aperture 283 formed in the front wall 261, and a corresponding upper rear aperture 285, middle rear aperture 286 and a lower rear aperture 287 formed in the rear wall 265. In the embodiment shown, the at least one pivoting feature 280 includes both a front recess and a rear recess for pivotally engaging a single coupling member 106, and thus form a pair of apertures.

Additionally, in the embodiment shown, the front aperture and the rear aperture of a pair is formed in the front and rear walls 261 and 265 at a same location along the height 271, and are thus aligned with each other (such as the pair of aligned upper front and rear apertures 281 and 285 formed at a same upper location along the height 271, the pair of aligned middle front and rear apertures 282 and 286 formed at a same middle location along the height 271, and the pair of aligned lower front and rear apertures 283 and 287 both formed a same lower location along the height 271). Each of the apertures 281, 282, 283, 285, 286 and 287 have a generally circular cross-section.

The pivotal engagement of a pair of apertures of the vertical member 102 with a corresponding pair of front and rear pivoting projections of a coupling member 106 pivotally engages the coupling member 106 to the specific location along the height 271. The location of the front and rear apertures 281, 282, 283, 285, 286 and 287 along the height 271 generally correspond to the locations where the vertical member 102*a* is to be coupled to the at least one horizontal rail 110, and may be selected based on the desired visual effect for a particular barrier system. In the embodiment shown in FIG. 8, the vertical member 102*a* is adapted for use in the barrier system 100 shown in FIG. 1 having the flat top and also having a flat bottom (where the vertical members 102 do not extend past the lower horizontal rail 113). As such, in the embodiment shown, the upper apertures 281 and 285 are located along the height 271 close to the upper end 273 while the lower apertures 283 and 287 are located along the height 271 close to the lower end 274. Additionally, a first spacing distance 294 between the upper apertures 281 and 285 and the middle apertures 282 and 286 may vary depending on the desired first spacing distance 114 (shown in FIG. 1) between the upper and middle horizontal rails 111 and 112. Similarly, a second spacing distance 295 between the middle apertures 282 and 286 and the lower apertures 283 and 287 may vary depending on the desired second spacing distance 115 (shown in FIG. 1) between the middle and lower horizontal rails 112 and 113. In other embodiments, such as in embodiments where the vertical member 102*a* is adapted for the barrier system 100' shown in FIG. 7 having the extended top and also having an extended bottom (where the vertical members 102 extend past the lower horizontal rail 113), the upper apertures 281 and 285 may be at a location further from the upper end 273, while the lower apertures 283 and 287 may be at a location further from the lower end 274. In yet other embodiments, the at least one pivoting feature 280 may include more or fewer pairs of the front and rear apertures, depending on the number of horizontal rails 110 to be coupled with the vertical member 102*a*.

In yet other embodiments, rather than through apertures formed in the front and rear walls 261 and 265, the at least one pivoting feature 280 may instead comprise dimples or recesses formed in the front and rear walls 261 and 265, which may be used when the vertical member 102*a* has the solid configuration. In yet other embodiments, the at least one pivoting feature 280 may only include front apertures formed in the front wall 261 (and not include any rear apertures formed in the rear wall 265) or may only include rear apertures formed in the rear wall 265 (and not include any front apertures formed in the front wall 261), which may be adapted to pivotally engage coupling members 106 that only include a corresponding front pivoting projection or only include a corresponding rear pivoting projection. In yet other embodiments, the front wall 261 may include front apertures and the rear wall 265 may include rear apertures, however a particular front aperture may not be paired with any rear aperture and a particular rear aperture may not be paired with any front apertures. Such embodiments may be adapted to pivotally engage both coupling members 106 which only include a front pivoting projection and coupling members 106 which only include a rear pivoting projection along the height 271 of a single vertical member 102*a*, and may improve stability of the barrier system 100 by alternating engagement points between the front and rear walls 261 and 265. In yet other embodiments, the front aperture may have a shape and dimensions different from a paired rear aperture, which may be adapted to pivotally engage coupling members 106 having a corresponding pair of front and rear position projections which are shaped and dimensioned differently from each other. In other embodiments, the front and rear apertures 281, 282, 283, 285, 286 and 287 may have different shapes and different dimensions than that described above. In yet other embodiments, certain front apertures may have a shape and dimensions different from other front apertures and/or certain rear apertures may have a shape and dimensions different from other rear apertures which may be adapted to pivotally engage different types of coupling members 106 along the length 271 of a single vertical rail 102*a*. In yet other embodiments, a pair of front and rear apertures for pivotally engaging a single coupling member 106 may be located at different locations along the length 271 and may not be aligned with each other, which may be adapted to engage coupling members 106 which include a corresponding pair of unaligned front and rear pivoting projections.

Figure 10:
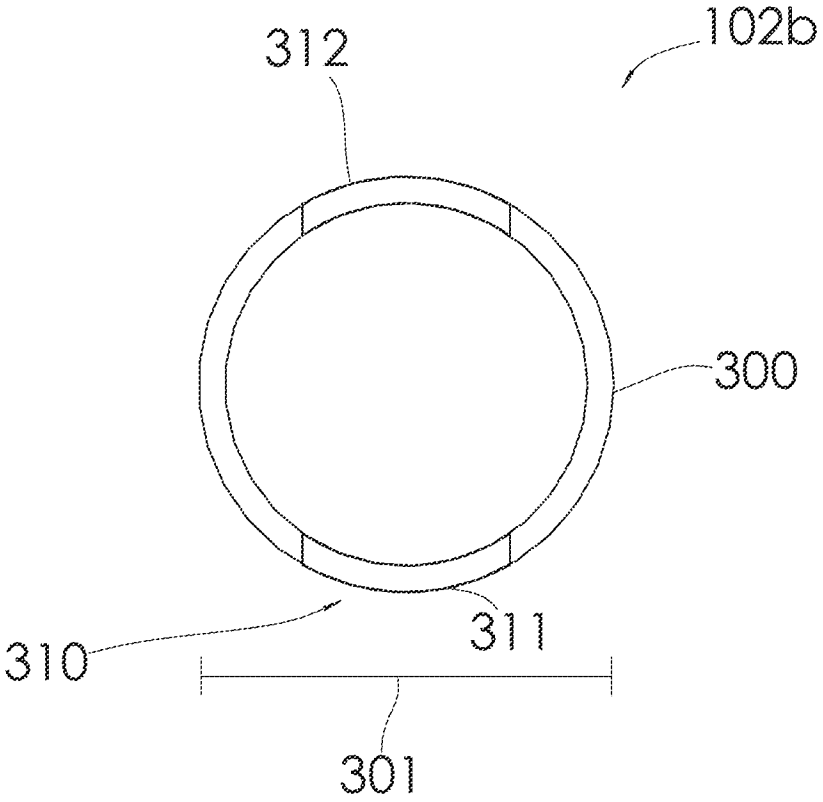
FIG. 10 is a sectional view of a vertical member of the barrier system of FIG. 1 in accordance with another embodiment.

Referring now to FIG. 10, another embodiment of the vertical member 102 is generally shown at 102*b*. The vertical member 102*b* may function as any of the vertical members 102 (shown in FIG. 1) in the barrier system 100. Similar to the vertical member 102*a*, the vertical member 102*b* may also have a hollow configuration and may also be formed from metal materials such as iron-based metals, aluminium-based metals or steel-based metals and may specifically be formed from 6063 aluminium alloy. However, the vertical member 102*b* has a generally cylindrical configuration and a circular cross-section formed from a single circumferential wall 300 and has a diameter 301.

The vertical member 102*b* may also be shaped and dimensioned to be received within (1) a channel of the at least one horizontal rail 110; (2) an aperture in a top wall of the at least one horizontal rail 110; and (3) and an aperture of the at least one coupling member 106. In this respect, for the vertical member 102*b* to be received in the aperture in the top wall of the at least one horizontal rail 110, the aperture may have a similar circular cross-section and an aperture diameter, and the diameter 301 may be less than the aperture diameter. For the vertical member 102*b* to be received in the aperture of the at least one coupling member 106, the aperture may have a similar circular cross-section and an aperture diameter, and the diameter 301 may be less than the aperture diameter.

The vertical member 102*b* also includes at least one pivoting feature 310 configured to pivotally engage at least one corresponding pivoting feature of the at least one coupling member 106, to pivotally couple the vertical member 102*b* with the at least one coupling member 106 and to position the at least one coupling member 106 at specific locations along a height of the vertical member 102*b*, without any welding or other permanent attachment mechanisms between the coupling member 106 and the vertical member 102*c*. The at least one pivoting feature 310 may be similar to the at least one pivoting feature 280 of the vertical member 102*a* (shown in FIGS. 8 and 9). In this respect, in the embodiment shown, the at least one pivoting feature 310 also comprises pairs of aligned apertures located along the height of the vertical member 102*b*, where the locations of the pairs of apertures along the height also corresponds to the locations where the vertical member 102*b* is to be coupled to the at least one horizontal rail 110. The apertures may also have a generally circular cross-section. A pair of apertures may also be configured to receive a single coupling member 106 having a corresponding pair of front and rear pivoting projections. Due to the single circumferential wall 300 of the vertical member 102*b*, the at least one pivoting feature 310 may comprise front apertures (upper front aperture 302 shown in FIG. 10) formed in the circumferential wall 300 and rear apertures (upper rear aperture 303 shown in FIG. 10) also formed in the circumferential wall 300 but diametrically opposed to the front apertures. For example, referring to FIG. 10, the upper front aperture 302 may be formed at the 6 o'clock position while the paired upper rear aperture 303 may be formed at the 12 o'clock position.

In other embodiments, the at least one pivoting feature 310 may: (1) comprise dimples or recesses formed in the circumferential wall 300; (2) only include front apertures (and not include any rear apertures) or may only include rear apertures (and not include any front apertures); (3) include both front and rear apertures, but a particular front aperture may not be paired or aligned with any rear apertures and a particular rear aperture may not be paired or aligned with any front apertures; (4) include front apertures having a different shape and dimensions from a paired rear aperture; (5) include front apertures having shapes and dimensions different from other front apertures and/or rear apertures having shapes and dimensions different from other rear apertures; (6) include front apertures which are not aligned with a paired rear aperture; and (7) include apertures having different shapes and different dimensions than that described above, all of the above similar to alternative embodiments described in association with the at least one pivoting feature 280 of the vertical member 102*a* (shown in FIGS. 8 and 9).

Figure 11:
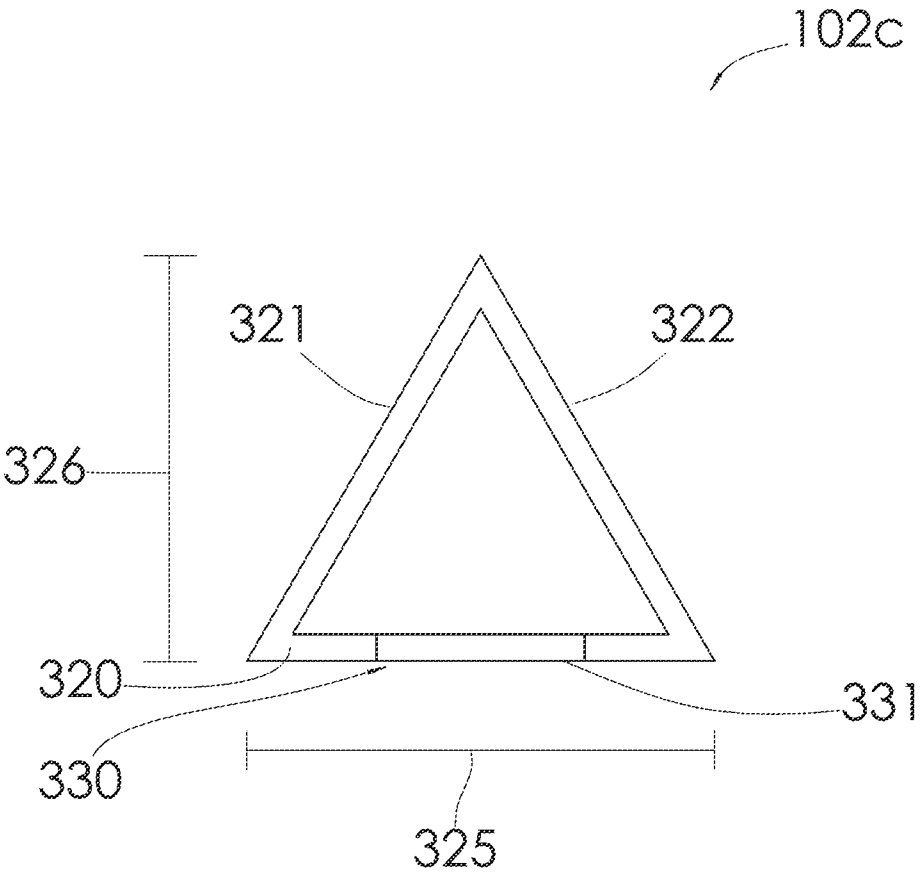
FIG. 11 is a sectional view of a vertical member of the barrier system of FIG. 1 in accordance with another embodiment.

Referring now to FIG. 11, another embodiment of the vertical member 102 is generally shown at 102*c*. The vertical member 102*c* may function as any of the vertical members 102 (shown in FIG. 1) in the barrier system 100. Similar to the vertical members 102*a* (shown in FIGS. 8 and 9) and 102*b* (shown in FIG. 10), the vertical member 102*c* may also have a hollow configuration and may also be formed from metal materials. However, the vertical member 102*c* has a triangular prism configuration and a triangular cross-section formed from a front wall 320, a first sidewall 321, and a second sidewall 322. The vertical member 102*c* also has a length 325 and a width 326.

The vertical member 102*c* is shaped and dimensioned to be received within (1) a channel of the at least one horizontal rail 110; (2) an aperture in a top wall of the at least one horizontal rail 110; and (3) and an aperture of the at least one coupling member 106. In this respect, for the vertical member 102*b* to be received in the aperture in the top wall of the at least one horizontal rail 110, the aperture may have a corresponding triangular cross-section, an aperture length and an aperture width, and the length 325 and the width 326 may be less than the aperture length and the aperture width of the aperture. For the vertical member 102*b* to be received in the aperture of the at least one coupling member 106, the aperture may have a corresponding triangular cross-section, an aperture length and an aperture width, and the length 325 and the width 326 may be less than the aperture length and the aperture width of the aperture.

The vertical member 102*c* also includes at least one pivoting feature 330 configured to pivotally engage the corresponding at least one pivoting feature of the at least one coupling member 106 to pivotally couple the vertical member 102*c* to the at least one coupling member 106 and to position the at least one coupling member 106 at specific locations along a height of the vertical member 102*c* without any welding or other permanent attachment mechanisms between the vertical member 102*c* and the at least one coupling member 106. In the embodiment shown, the at least one pivoting feature 330 may be similar to the at least one pivoting feature 280 of the vertical member 102*a* (shown in FIGS. 8 and 9) and the at least one pivoting feature 310 of the vertical member 102*b* (shown in FIG. 10). In this respect, the at least one pivoting feature 330 may also comprise apertures located along the height of the vertical member 102*c* at locations corresponding to locations where the vertical member 102*c* is to be coupled to the at least one horizontal rail 110. The apertures may also have a generally circular cross-section. However, due to the triangular cross-section of the vertical member 102*c*, the at least one pivoting feature 330 may only include front apertures formed in the front wall 320 (upper front aperture 331 shown in FIG. 11). A particular front aperture may be adapted to pivotally engage a single coupling member 106 having only a front pivoting projection.

In other embodiments, the at least one pivoting feature 310 may: (1) comprise dimples or recesses formed in the front wall 320; (2) include front apertures having shapes and dimensions different from other front apertures; and (3) include apertures having different shapes and different dimensions than that described above, all of the above similar to alternative embodiments described in association with the at least one pivoting feature 280 of the vertical member 102*a* (shown in FIGS. 8 and 9).

The barrier system 100 further includes the at least one coupling member 106 configured to pivotally couple the vertical members 102 with the at least one horizontal rail 110 (shown in FIG. 1). Referring briefly back to FIGS. 3 and 6, in the embodiment shown, a respective coupling member 106 is adapted to engage the horizontal rail 110*a* at each specific location along the length 130 where a pair of aligned front and rear recesses 143 and 147 are located and is adapted to engage the horizontal rail 110*b* at each specific location along the length 190 where a pair of aligned front and rear recesses 223 and 227 are located. Referring briefly back to FIG. 8, in the embodiment shown, a respective coupling member 106 is adapted to pivotally couple to the vertical member 102*a* at each specific location along the height 271 where a pair of aligned front and rear apertures are located (such as the pair of aligned upper front and rear apertures 281 and 285, the pair of aligned middle front and rear apertures 282 and 286, and the pair of aligned lower front and rear apertures 283 and 287 for example). Accordingly, a particular coupling member 106 is adapted to engage both the vertical member 102 and the horizontal rail 110 at an intersection thereof.

Referring now to FIGS. 12-15, an embodiment of the at least one coupling member 106 is shown generally at 102*a*. The coupling member 102*a* may function as the coupling member 106 pivotally coupling any one of the vertical members 102 (such as the vertical member 102*a* shown in FIGS. 8 and 9 for example) with the upper horizontal rail 111 (such as the horizontal rail 110*a* shown in FIGS. 2-4 for example) of the barrier system 100 without any welding or other permanent attachment mechanisms between the coupling member 106*a*, the vertical member 102*a* or the horizontal rail 110*a*. The coupling member 106*a* may be made from plastic materials or composite materials such as nylon for example. The coupling member 106*a* may be manufactured using plastic injection moulding or vacuum forming techniques.

In the embodiment shown, the coupling member 106 a includes a body 340 and a cover 345. The body 340 is shaped and dimensioned to be received in the channel 133 of the horizontal rail 110*a* (show in FIGS. 2-4) and to receive the vertical member 102*a* (shown in FIGS. 8 and 9). In the embodiment shown, the body 340 has a rectangular cuboid configuration and a corresponding rectangular cross-section. The body 340 has an upper end 341 and a lower end 342. The rectangular cuboid configuration of the body 340 is formed from a front wall 350, a rear wall 360, a first support 371 and a second support 375. The front wall 350 includes a first end 351 and a second end 352. The rear wall 360 has a similar and opposed configuration including a first end 361 and a second end 362. The first support 371 extends between the first ends 351 and 361 proximate the upper end 341 of the body 340. The second support 375 extends between the second ends 352 and 362, also proximate the upper end 341. The body 340 comprises a body length 390, a maximum body width 391, a minimum body width 392, and a body height 393 (best seen in FIG. 15). For the coupling member 106*a* to be received within the channel 133 of the horizontal rail 110*a*, the maximum body width 391 and the body height 393 is less than, respectively, the width 132 and the height 131 of the horizontal rail 110*a* (shown in FIGS. 2-4). In the embodiment shown, the body length 390, the maximum body width 391, the minimum body width 392, and the body height 393 may be, respectively, approximately 2.8 cm (1.1 inches), 2.56 cm (1 inches), 1.59 cm (0.625 inches) and 2.41 cm (0.95 inches). In other embodiments, the body length 390, the maximum body width 391, the minimum body width 392, and the body height 393 may be different and may vary depending on dimensions of the horizontal rail 110*a* and the vertical member 102*a*.

The front and rear walls 350 and 360 and the first and second supports 371 and 375 also define the aperture 343. The aperture 343 is shaped and dimensioned to receive the vertical member 102*a* and has a rectangular cross-section corresponding to the rectangular cross-section of the vertical member 102*a*. The aperture 343 has an aperture length 395 and an aperture width 396. For the vertical member 110*a* to be received within the aperture 343, the aperture length 395 and aperture width 396 is greater than, respectively, the length 270 and the width 272 of the vertical member 102*a* (shown in FIGS. 8 and 9). In the embodiment shown, the aperture length 395 and the aperture width 396 are, respectively, approximately 2.22 cm (0.875 inches) and 1.65 cm (0.65 inches). In other embodiments, the aperture length 395 and width 396 may be different and may vary depending on dimensions of the vertical member 102*a*.

In embodiments where the coupling member 106*a* is configured to receive vertical members 102 having a different shape, the body 340 may have a different shape, different dimensions and may include different components. For example, in embodiments where the coupling member 106*a* is configured to receive the vertical member 102*b* (shown in FIG. 10) having the circular cross-section, the body 340 may have a generally cylindrical configuration and a corresponding circular cross-section defined by curved front and rear walls and curved first and second supports extending therebetween. The curved front and rear walls and curved first and second supports may define an aperture having a circular cross-section and an aperture diameter which is greater than the diameter 301 of the vertical member 102*b* (shown in FIG. 10). In embodiments where the coupling member

106*a* is configured receive the vertical member 102*c* (shown in FIG. 11) having the triangular cross-section, the coupling member 106*a* may have a generally triangular prism shape and a corresponding triangular cross-section defined by a single front wall, a first support coupled to a first end of the front wall and a second support coupled to a second end of the front wall, wherein the first and second supports are further coupled directly to each other. The front wall and first and second supports may define an aperture having a triangular cross-section and having an aperture width and an aperture length which are greater than, respectively, the length 325 and the width 326 of the vertical member 102*c* (shown in FIG. 11).

In the embodiment shown in FIGS. 12-15, the coupling member 106*a* further includes the cover 345 shaped and dimensioned to rest on top of the body 340 and which may facilitate insertion of the vertical member 102*a* into the aperture 343. In the embodiment shown, the cover 345 has a rectangular cross-section and dimensions corresponding to the rectangular cross-section of the body 340. The cover 345 is coupled to the upper end 341 of the body 340 to cover the front and rear walls 350 and 360 and the first and second supports 371 and 375 without covering the aperture 343. The cover 345 includes a curved top surface 346 which may urge portions of the vertical member 102*a* contacting the curved top surface 346 (such as during assembly of the barrier system 100) to slide into the aperture 343.

In certain embodiments, the coupling member 106*a* may not include the cover 345 (and only include the body 340 for example). Additionally, in embodiments where the body 340 is shaped to receive a vertical member different from the vertical member 102*a*, the cover 345 may similarly be different. For example, in embodiments where the coupling member 106*a* is configured to receive the vertical member 102*b* (shown in FIG. 10) having the circular cross-section, the cover 345 may instead have a circular cross-section corresponding to the circular cross-section of the body 340. Similarly, in embodiments where the coupling member 106*a* is configured to receive the vertical member 102*c* (shown in FIG. 11) having the triangular cross-section, the cover 345 may instead have a triangular cross-section corresponding to the triangular cross-section of the body 340.

The coupling member 106*a* further includes the at least one positioning feature 400. The at least one positioning feature 400 is configured to engage at least one horizontal rail 110 (such as the horizontal rail 110*a* shown in FIGS. 2-4 for example) to retain the coupling member 106*a* within the channel of the at least one horizontal rail 110 and to position the coupling member 106*a* at the specific locations along the length of the at least one horizontal rail 110 without any welding or other permanent attachment mechanisms between the coupling member 106*a* and at least one the horizontal rail 110. In the embodiment shown in FIG. 12-15, the at least one positioning feature 400 is shaped and dimensioned to engage the at least one positioning feature 140 of the horizontal rail 110*a* (shown in FIGS. 2-4), to position the coupling member 106*a* along the length 130 and to retain the coupling member 106*a* within the channel 133.

In the embodiment shown, the at least one positioning feature 400 includes a front flange 401 extending from an outer surface of the front wall 350 and a rear flange 405 extending from an outer surface of the rear wall 360. The front and rear flanges 401 and 405 may extend from the front and rear walls 350 and 360 at a same location along the body height 393 (best seen in FIG. 15) and are thus aligned with each other. The aligned front and rear flanges 401 and 405 may be shaped and dimensioned to sufficiently engage, respectively, the front and rear ledges 141 and 145 of the horizontal rail 110*b* (shown in FIGS. 2-4). In the embodiment shown, the front and rear flanges 401 and 405 are substantially identical, each have a triangular prism configuration, and have, respectively, an extension width 402 and an extension width 406 (best shown in FIG. 15). The extension widths 402 and 406 are dimensioned to enable the front and rear flanges 401 and 405 to sufficiently engage the front and rear ledges 141 and 145 to prevent the coupling member 106*a* from falling out of the channel 133. In the embodiment shown, the extension widths 402 and 406 are both approximately 0.229 cm (0.09 inches). In other embodiments, the extension widths 402 and 406 may be different and may very depending on dimensions of the front and rear ledges 141 and 145 of the horizontal rail 110*a* and dimensions of the coupling member 106*a* and the horizontal rail 110*a*.

In other embodiments, the at least one positioning feature 400 may include front and rear flanges 401 and 405 which have different shapes (such as a rectangular cuboid or cylinder for example) or different dimensions than that described above. In yet other embodiments, the front flange 401 may have a shape and dimensions different from the rear flange 405, which may be adapted to engage horizontal rails 110*a* having corresponding front and rear ledges 141 and 145 which are also shaped and dimensioned differently from each other. In yet other embodiments, the front and rear flanges 401 and 405 may extend at different locations along the body height 393 and may not be aligned with each other, which may be adapted to engage horizontal rails 110*a* that have corresponding unaligned front and rear ledges 141 and 145.

The at least one positioning feature 400 further includes the front positioning projection 411 extending from the front flange 401 and the rear positioning projection 415 extending from the rear flange 405. In the embodiment shown, both the front and rear positioning projections 411 and 415 are used for retaining and positioning a single coupling member 106*a* at the specific location along the length 130 of the horizontal rail 110*a*, and thus form a pair of positioning projections. Additionally, in the embodiment shown, the front and rear positioning projections 411 and 415 both extend at approximately same location along the body length 390 (best seen in FIG. 13) and are thus also aligned with each other. The pair of aligned front and rear positioning projections 411 and 415 may be shaped and dimensioned to be received in a corresponding pair of aligned front and rear recesses 143 and 147 of the horizontal rail 110*b* (shown in FIGS. 2-4). The engagement of the pair of front and rear positioning projections 411 and 415 with a corresponding pair of front and rear recesses 143 and 147 positions the coupling member 106*a* at the specific location along the length 130 of the horizontal rail 110*a* without any welding or other permanent attachment mechanisms between the coupling member 106*a* and the horizontal rail 110*a*.

In the embodiment shown, the front and rear positioning projections 411 and 415 are substantially identical to each other and each have a generally rectangular cuboid configuration. The front positioning projection 411 has a projection width 412 (best seen in FIG. 15) and a projection length 413 (best seen in FIGS. 12 and 13), and the rear positioning projection 415 has a projection width 416 (best seen in FIG. 15) and a projection length 417 (best seen in FIG. 13). For the front and rear positioning projections 411 and 415 to be received in a corresponding pair of front and rear recesses 143 and 147, the projection widths 412 and 416 are less than, respectively, the extension widths 142 and 146 of the front and rear ledges 141 and 145 and the projection lengths 413 and 417 are less than the lengths of the front and rear recesses 143 and 147. Projection widths 412 and 416 may be substantially the same as the extension widths 402 and 406 of the front and rear flanges 401 and 405 (best seen in FIG. 15) (such that the front and rear positioning projections 411 and 415 extend the entire extension widths 402 and 406 of the front and rear flanges 401 and 405) to provide greater stability and retention of the coupling member 106*a* in the channel 133 when the pair of front and rear positioning projections 411 and 415 are received in the corresponding pair of front and rear recesses 143 and 147 and the front and rear flanges 401 and 405 engage the front and rear ledges 141 and 145. In the embodiment shown, the projection widths 412 and 416 are both approximately 0.229 cm (0.09 inches) and the projection lengths 413 and 417 are both approximately 0.483 cm (0.19 inches). In other embodiments, the projection widths and lengths 412, 416, 413 and 417 may be different and may vary depending on dimensions of the corresponding pair of front and rear recesses 143 and 147 and dimensions of the front and rear ledges 141 and 145 and also dimensions of the front and rear flanges 401 and 405. For example, in embodiments where the widths of the front and rear recesses 143 and 147 are greater than the entire extension widths 142 and 146 of the front and rear ledges 141 and 145 of the horizontal rail 110*a*, the projection widths 412 and 416 of the front and rear positioning projections 411 and 415 may be greater than the entire extension width 402 and 406 of the front and rear flanges 401 and 405 of the coupling member 106.

In other embodiments, the at least one positioning feature 400 may include more or fewer pairs of the front and rear positioning projections 411 and 415, which may be adapted to engage horizontal rails 110*a* which include more than one pair of front and rear recesses 143 and 147 for positioning a single coupling member 106. In yet other embodiments, the coupling member 106*a* may only include the front positioning projection 411 (with no rear positioning projection 415) or may only include the rear positioning projection 415 (with no front positioning projection 411), which may be adapted to engage horizontal rails 110*a* which only include the front recesses 143 (with no rear recesses 147) or which only include the rear recesses 147 (with no front recesses 143). In yet other embodiments, the front positioning projection 411 may be paired with more than one rear positioning projection and/or the rear positioning projection 415 may be paired with more than one front positioning projection. Such embodiments may be adapted to engage horizontal rails 110*a* which include one front recess 143 paired with more than one rear recess 147 and/or which include one rear recess 147 paired with more than one front recess 143 for positioning a single coupling member 106.

In other embodiments, the front and rear positioning projections 411 and 415 may have different shapes (such as a polyhedron, triangular prism or cylinder for example) and different dimensions than that described above. In yet other embodiments, the front positioning projection 411 may have a shape and dimensions different from a paired rear positioning projection 415, which may be adapted to engage horizontal rails 110*a* having a corresponding pair of front and rear recesses 143 and 147 which are also shaped and dimensioned differently from each other. In yet other embodiments, the front and rear positioning projections 411 and 415 may be located at different locations along the body length 390 and may not be aligned with each other, which may be adapted to engage horizontal rails 110*a* which include a corresponding pair of unaligned front and rear recesses 143 and 147 for positioning a single coupling member 106*a*.

The coupling member 106*a* further includes the at least one pivoting feature 430. The at least one pivoting feature 430 is configured to pivotally engage the vertical member 102 (such as the vertical member 102*a* shown in FIGS. 8 and 9 for example) at a specific location along a height of the vertical member 102 without any welding or other permanent attachment mechanisms between the coupling member 106*a* and the vertical member 102 and to allow the vertical member 102 to pivot relative to the coupling member 106*a*. As described above, the at least one positioning feature 400 is configured to position the coupling member 106*a* at a specific location along the length of the at least one horizontal rail 110. The combination of the at least one positioning feature 400 and the at least one pivoting feature 430 thus couple the vertical member 102 and the at least one horizontal rail 110 via the coupling member 106*a* (without any welding or other permanent attachment mechanisms between the coupling member 106*a*, the vertical member 102 or the at least one horizontal rail 110) and allows the vertical member 102 to pivot relative to the at least one horizontal rail 110 by pivoting relative to the coupling member 106*a*. The at least one pivoting feature 430 is further configured to retain the vertical member 102 within the aperture 343 and prevent (or restrict/discourage) any downward movement of the vertical member 102 relative to the coupling member 106*a*. In the embodiment shown in FIGS. 12-15, the at least one pivoting feature 430 is shaped and dimensioned to pivotally engage the corresponding at least one pivoting feature 280 of the vertical member 102*a* (shown in FIGS. 8 and 9).

In the embodiment shown, the at least one pivoting feature 430 comprises a front tab 431 formed in the front wall 350 and a rear tab 441 formed in the rear wall 360. Both the front and rear tabs 431 and 441 cooperate to engage a corresponding pair of aligned apertures at a same location along the height 271 of the vertical member 102*a* (such as the pair of aligned upper front and rear apertures 281 and 285 shown in FIGS. 8 and 9 for example), and thus form a pair of tabs. Additionally, in the embodiment shown, the pair of front and rear tabs 431 and 441 are formed in the front and rear walls 350 and 360 at approximately a same location along the body height 393 and at approximately a same location along the body length 390, and are thus also aligned with each other.

Figure 12:
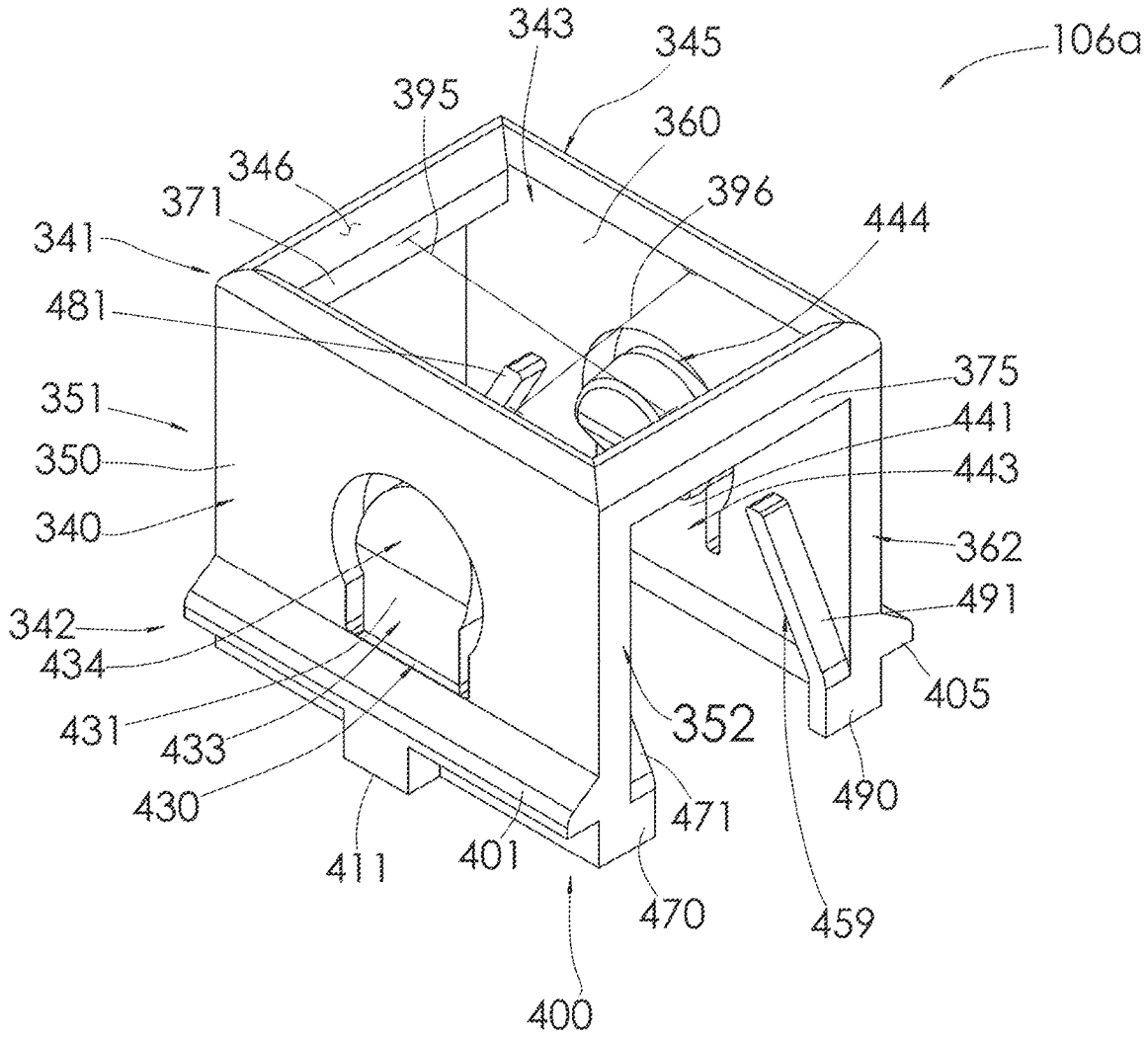
FIG. 12 is a front perspective view of a coupling member of the barrier system of FIG. 1 in accordance with on one embodiment.
Figure 13:
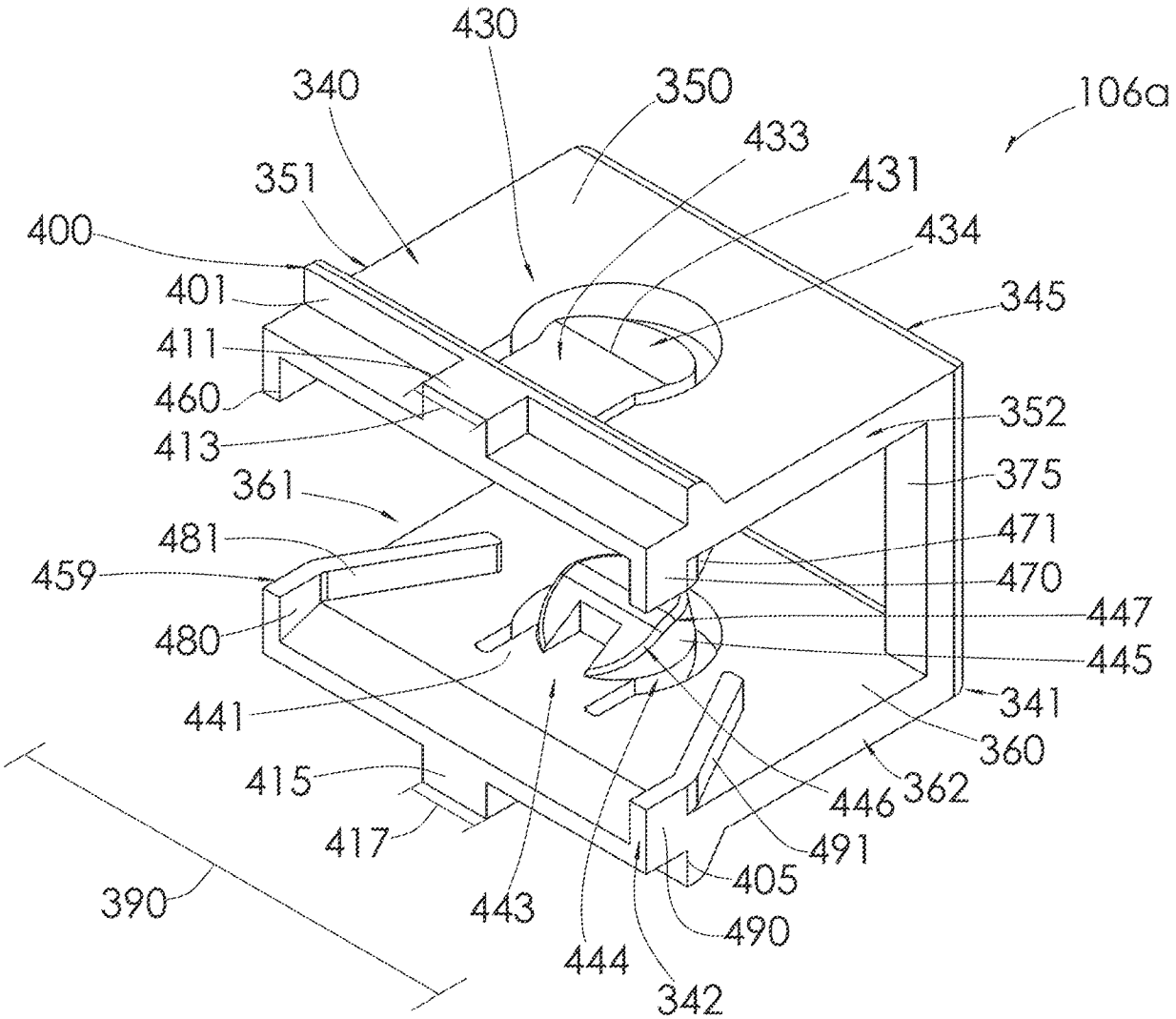
FIG. 13 is a rear perspective view of the coupling member of FIG. 12.

The front tab 431 includes an attachment portion 433 connected to the front wall 350 near the lower end 342 of the body 340 and a deflection portion 434 extending upward toward the upper end 341 from the attachment portion 433, such that the front tab 431 comprises an upward facing tab (best seen in FIGS. 12 and 13). The rear tab 441 has a similar configuration and includes an attachment portion 443 connected to the rear wall 360 near the lower end 342 and a deflection portion 444 extending upward towards the upper end 341 from the attachment portion 443, such that the rear tab 441 also comprises an upward facing tab (best seen in FIGS. 13 and 14). The attachment portions 433 and 443 allow, respectively, the deflection portion 434 to deflect relative to the front wall 350 and the deflection portion 444 to deflect relative to the rear wall 360 when the vertical member 102*a* is inserted into the aperture 343 during assembly of the barrier system 100.

In the embodiment shown, the at least one pivoting feature 430 further includes a front pivoting projection 435 extending from an inner surface of the front tab 431 (best seen in FIG. 15) and a rear pivoting projection 445 extending from an inner surface of the rear tab 441 (best seen in FIGS. 13-15), such that the front and rear pivoting projections 435 and 445 face each other. The front and rear pivoting projections 435 and 445 cooperate together to engage a corresponding pair of aligned apertures at the same location along the height 271 of the vertical member 102*a* and thus form a pair of pivoting projections. Additionally, both the front and rear pivoting projections 435 and 445 extend from the aligned front and rear tabs 431 and 441 and are thus also located in the front and rear walls 350 and 360 at approximately a same location along the body height 393 and at approximately a same location along the body length 390, and are thus also themselves aligned with each other.

The front pivoting projection 435 is shaped and dimensioned to be pivotally received within a front aperture in the front wall 261 of the vertical member 102*a* (such as the upper front aperture 281 shown in FIGS. 8 and 9 for example) and the rear pivoting projection 445 is shaped and dimensioned to be pivotally received within a rear aperture in the rear wall 265 of the vertical member 102*a* (such as the upper rear aperture 285 shown in FIGS. 8 and 9 for example). In the embodiment shown, the front and rear pivoting projections 435 and 445 are substantially identical to each other, and each have a generally cylindrical configuration and a diameter. The cylindrical configuration allows the front and rear pivoting projections 435 and 445 to be pivotally received in the upper front and rear apertures 281 and 285 having the corresponding circular cross-section. For the front and rear pivoting projections 435 and 445 to be pivotally received within, respectively, the front and rear apertures 281 and 285, the diameter of the front pivoting projection 435 is less than a diameter of the front aperture 281, and the diameter of the rear pivoting projection 445 is less than a diameter of the rear aperture 285. In the embodiment shown, the diameter of the front and rear pivoting projections 435 and 445 are both approximately 0.813 cm (0.32 inches). In other embodiments, the diameter of the front and rear pivoting projections 435 and 445 may be different and may vary depending on dimensions of the front and rear apertures of the vertical member 102*a*.

Figure 14:
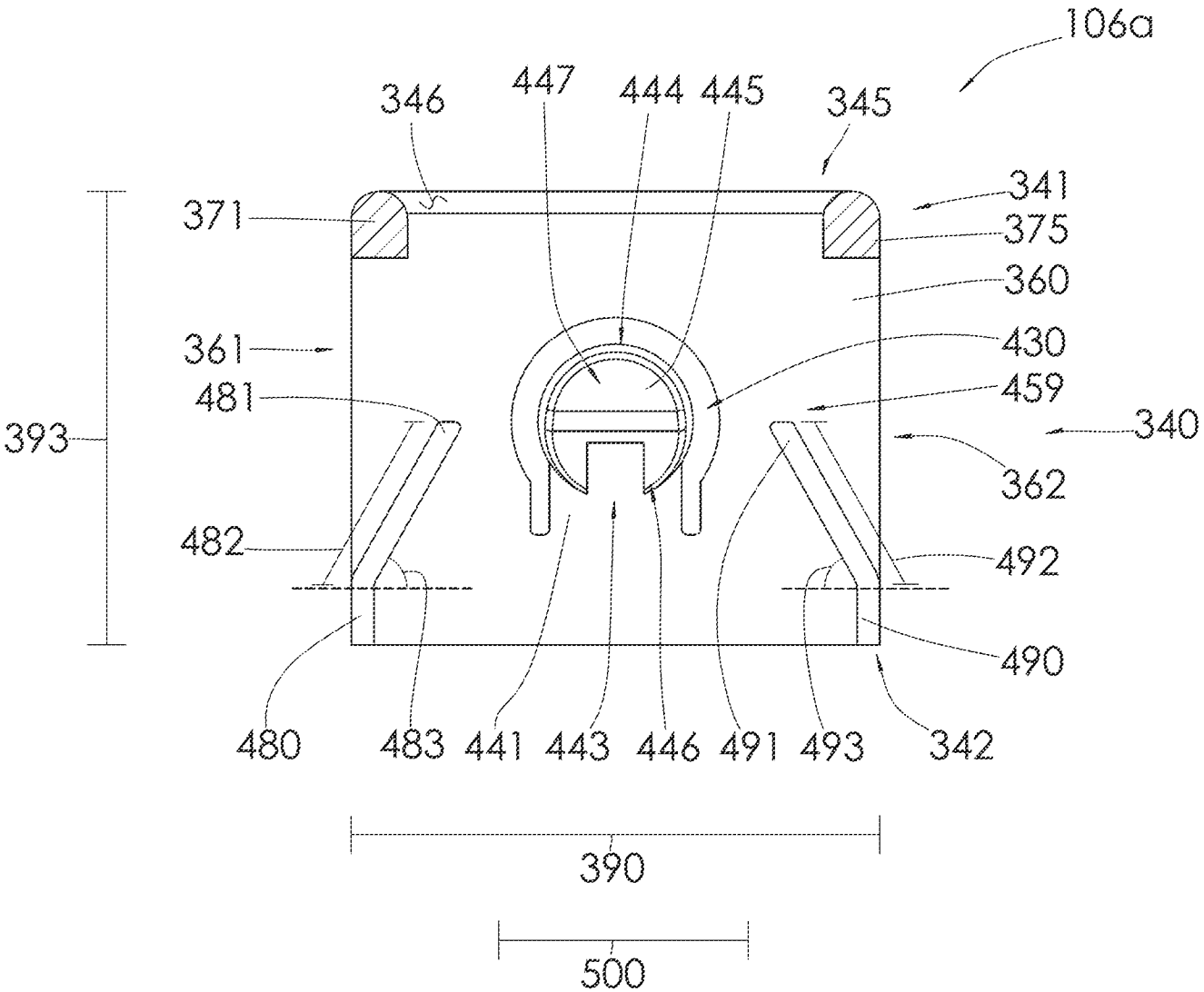
FIG. 14 is a sectional view of the coupling member of FIG. 12.
Figure 15:
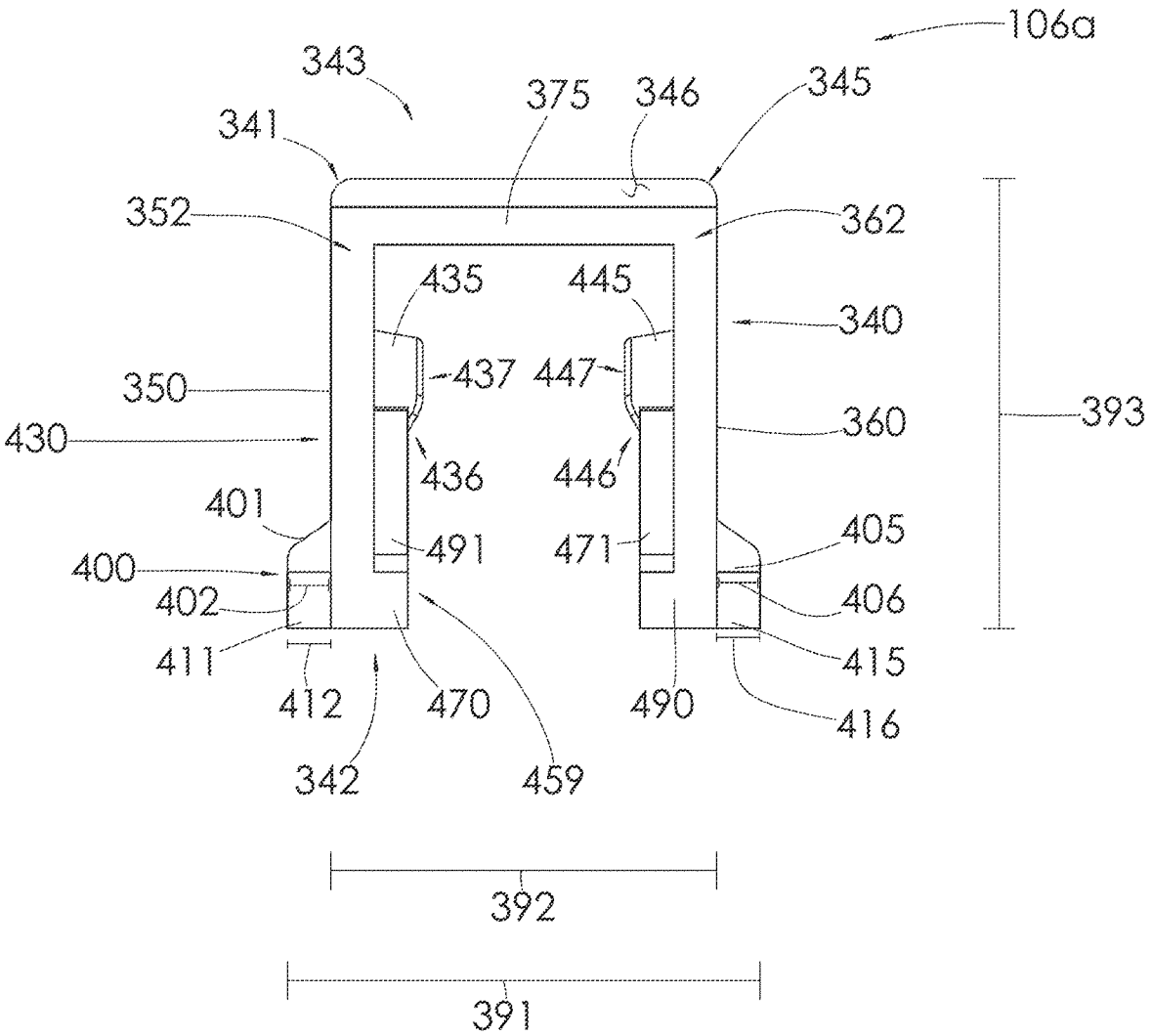
FIG. 15 is an end view of the coupling member of FIG. 12.

In the embodiment shown, the front pivoting projection 435 includes an upwardly sloped portion 436 extending from the attachment portion 433 and a retaining portion 437 extending from the deflection portion 434 (best seen in FIG. 15). The rear pivoting projection 445 also includes an upwardly sloped portion 446 extending from the attachment portion 443 and a retaining portion 447 extending from the deflection portion 444 (best seen in FIGS. 13-14). A width of the upwardly sloped portions 436 and 446 increases from the attachment portions 433 and 443 until it becomes a width of the retaining portions 437 and 447. The smaller width of the upwardly sloped portions 436 and 446 may facilitate insertion of, respectively, the front pivoting projection 435 into the front aperture 281 and the rear pivoting projection 445 into the rear aperture 285 during assembly of the barrier system 100. The larger width of the retaining portions 437 and 447 may securely engage the front and rear pivoting projections 435 and 445 in the corresponding upper apertures 281 and 285 of the vertical member 102*a* when the barrier system 100 is assembled. In the embodiment shown, the width of the retaining portions 437 and 447 are both approximately 0.305 cm (0.12 inches). In other embodiments, the width of the retaining portions 437 and 447 may be different and may vary depending on dimensions of the corresponding apertures 281 and 285 and thickness of the front and rear walls 261 and 265 of the vertical member 102*a*. The combination of the upward facing front and rear tabs 431 and 441 and the upwardly sloped front and rear pivoting projections 435 and 445 enable insertion of the vertical member 102*a* into the aperture 343 from the lower end 342 towards the upper end 341 of the body 340 while preventing (or restricting or discouraging) any movement of an inserted and engaged vertical member 102*a* out of the aperture 343 downward from the lower end 342, and may make the coupling member 106*a* single-track (insertion possible upwards from the lower end 342 towards the upper end 341, but not vice versa). Preventing (or restricting or discouraging) downward movement of the vertical member 102*a* can improve stability of the barrier system 100 when assembled and when racking to change the angle 103 (see FIGS. 1 and 21).

In other embodiments, the at least one pivoting feature 430 may only include the front tab 431 and the front pivoting projection 435 (no rear tab 441 or rear pivoting projection 445), or only include the rear tab 441 and the rear pivoting projection 445 (with no front tab 431 or front pivoting projection 435). Such embodiments may be adapted to engage vertical members 102*a* which only include the upper front aperture 281 (with no upper rear aperture in the rear wall 265) or which only include the upper aperture 285 (with no upper front aperture 281 in the front wall 261). For example, embodiments of the coupling member 106*a* configured to receive the vertical member 102*c* having the triangular cross-section (shown in FIG. 11) may only include the front pivoting projection 435 to be received in the front aperture 331. In yet other embodiments, the front and rear pivoting projections 435 and 445 may be formed directly in the front and rear walls 350 and 360, with no deflectable front and rear tabs 431 and 441. In such embodiments, the coupling member 106 may instead deflect at connection points between the first and second supports 371 and 375 and the front and rear walls 350 and 360 when the vertical member 102*a* is inserted into the aperture 343.

In other embodiments, the sloped portions 436 and 446 and the retaining portions 437 and 447 of the front and rear pivoting projections 435 and 445 may have different dimensions and a different configuration. For example, the front pivoting projection 435 may have the retaining portion 437 extending from the attachment portion 433 and the sloped portion 436 extending from the deflection portion 434 and the rear pivoting projection 445 may have the retaining portion 447 extending from the attachment portion 443 and the sloped portion 446 extending from the deflection portion 444. Having the retaining portions 437 and 447 extending from closer to the lower end 342 of the body 340 may more securely engage the front and rear pivoting projections 435 and 445 in the front and rear apertures 281 and 285 of the vertical member 102*a*. In yet other embodiments, the front and rear pivoting projections 435 and 445 may only include the retaining portion 437 and 447 (with no sloped portions 436 and 446). In yet other embodiments, the front and rear tabs 431 and 441 may have different shapes (such as a square, triangle or polygonal shape for example) and different dimensions than that described above. In yet other embodiments, the front and rear pivoting projections 435 and 445 may have different shapes and different dimensions than that described above. In yet other embodiments, a front tab 431 may have a shape and dimensions different from a paired rear tab 441, or a front pivoting projection 435 may have a shape and dimensions different from a paired rear pivoting projection 445. Such embodiments may be adapted to pivotally engage vertical members 102*a* having a corresponding pair of front and rear apertures 281 and 285 which are shaped and dimensioned differently from each other. In yet other embodiments, the front and rear pivoting projections 435 and 445 may be located at different locations along the body length 390 or the body height 393, and may not be aligned with each other. Such embodiments may be adapted to engage vertical members 102*a* which include a corresponding pair of unaligned front and rear apertures 281 and 285.

The coupling member 106*a* further includes at least one retaining feature 459. The at least one retaining feature 459 is configured to contact at least one sidewall of the vertical member 102 (such as the first and second sidewalls 262 and 266 of the vertical member 102*a* shown in FIGS. 8 and 9 for example) received in the aperture 343. The at least one retaining feature 459 cooperates with the at least one pivoting feature 430 to retain the vertical member 102 within the aperture 343 and to prevent (or restrict/discourage) any downward movement of the vertical member 102 relative to the coupling member 106*a* and the at least one horizontal rail 110. In the embodiment shown in FIGS. 12-15, the at least one retaining feature 459 is shaped and dimensioned to contact the first and second sidewalls 262 and 266 of the vertical member 102*a* (shown in FIGS. 8 and 9) when the vertical member 102*a* is received in the aperture 343.

In the embodiment shown, the coupling member 106*a* further includes a first end front flap 460 extending from the first end 351 of the front wall 350 proximate the lower end 342 of the body 340, a second end front flap 470 extending from the second end 352 of the front wall 350 proximate the lower end 342, a first end rear flap 480 extending from the first end 361 of the rear wall 360 proximate the lower end 342, and a second end rear flap 490 extending from the second end 362 of the rear wall 360 proximate the lower end 342. The at least one retaining feature 459 comprises a first end front arm 461 extending from the first end front flap 460 and a second end front arm 471 extending from the second end front flap 470. The first end front arm 461 and the second end front arm 471 thus both extend from the front wall 350 and are mirror images of each other. The at least one retaining feature 459 further comprises a first end rear arm 481 extending from the first end rear flap 480 and a second end rear arm 491 extending from the second end rear flap 490. The first end rear arm 481 and the second end rear arm 491 both extend from the rear wall 360 and are mirror images of each other. Each of the arms 461, 471, 481 and 491 cooperate together to engage the first and second sidewalls 262 and 266 at the same location along the height 271 of the vertical member 102*a*, and thus form a set of arms. Additionally, each of the arms 461, 471, 481 and 491 extend to approximately a same location along the body height 393 and are thus aligned with each other.

Each of the arms 461, 471, 481 and 491 may be substantially identical to each other and all have a generally rectangular cuboid configuration. Each of the arms 461, 471, 481 and 491 have a respective arm length (an arm length 482 of the first end rear arm 481 and an arm length 492 of the second end rear arm 491 are shown in FIG. 14). Each of the arms 461, 471, 481 and 491 also extend from the respective flaps 460, 470, 480 and 490 inward and upward towards the upper end 341 of the body 340 at a respective arm angle relative to a horizontal of the body 340 (an arm angle 483 of the first end rear arm 481 and an arm angle 493 of the second end rear arm 491 are shown in FIG. 14). The respective arm lengths and respective arm angles of each of the arms 461, 471, 481 and 491 may be dimensioned such that a respective contact surface of the first end arms 461 and 481 are positioned to contact the first sidewall 262 and a respective contact surface of the second end arms 471 and 491 are positioned to contact the second sidewall 266 when the vertical member 102*a* is received within the aperture 343. For example, in the embodiment shown, the respective arm lengths and respective arm angles of each of the arms 461, 471, 481 and 491 may be dimensioned such that a separation distance 500 (shown in FIG. 14) between the first and second end front arms 461 and 471 and between the first and second end rear arms 481 and 491 is less than the length 270 of the vertical member 102*a* (shown in FIGS. 8 and 9). Additionally, the respective arm lengths and respective arm angles of each of the arms 461, 471, 481 and 491 may also be dimensioned to centre the vertical member 102*a* relative to at least one of the aperture length 395 and width 396 when the vertical member 102*a* is inserted within the aperture 343 to facilitate assembly of the barrier system 100, as the aperture length 395 and/or width 396 may be greater than, respectively, the length 270 and/or width 272 of the vertical member 102*a*. In the embodiment shown, the arm length of each of the arms 461, 471, 481 and 491 is approximately 0.95 cm (0.37 inches) and the arm angle of each of the arms 461, 471, 481 and 491 is approximately 30°. In other embodiments, the arm angle and arm length of each of the arms 461, 471, 481 and 491 may be different and may vary depending on dimensions of the vertical member 102*a* relative to dimensions of the coupling member 106*a*. For example, the arm length of each of the arms 461, 471, 481 and 491 may range between approximately 0.05 cm (0.02 inches) and approximately 2 cm (0.78 inches); similarly, the arm angle of each of the arms 461, 471, 481 and 491 may range between approximately 5° and approximately 85°.

Still referring to FIGS. 12-15, a connection point between the arms 461, 471, 481 and 491 and the respective flaps 460, 470, 480 and 490 may form a hinge point at which the arms 461, 471, 481 and 491 deflect relative to the respective flaps 460, 470, 480 and 490. The hinge points may be a living hinge comprising an area of reduced material or more flexible material. When the vertical member 102*a* is inserted into the aperture 343, the arms 461, 471, 481 and 491 may be deflected by the first and second sidewalls 262 and 266 at the respective hinge points and the respective arm angles may change. The inward extension of the arms 461, 471, 481 and 491 may bias the arms 461, 471, 481 and 491 to continually engage the first and second sidewalls 262 and 265 of the vertical member 102*a*, and this engagement may help retain the inserted vertical member 102*a* within the aperture 343. Further, the upward extension of the arms 461, 471, 481 and 491 may cooperate together with the upward facing front and rear tabs 431 and 441 and the upwardly sloped front and rear pivoting projections 435 and 445 of the at least one pivoting feature 430 to enable insertion of the vertical member 102*a* into the aperture 343 from the lower end 342 towards the upper end 341 of the body 340 while preventing (or restriction or discouraging) any movement of an inserted and engaged vertical member 102*a* out of the aperture 343 downward from the lower end 342, and may make the coupling member 106*a* single-track (insertion possible upwards from the lower end 342 towards the upper end 341, but not vice versa). As noted above, preventing (or restriction or discouraging) downward movement of the vertical member 102*a* can improve stability of the barrier system 100 when assembled and when racking.

In other embodiments, the at least one retaining feature 459 may only include either the front arms 461 and 471 or the rear arms 481 and 491, but not both. Such embodiments of the coupling member 106*a* may be easier to manufacture. Additionally, embodiments of the coupling member 106*a* configured to receive the vertical member 102*c* having the triangular cross-section (shown in FIG. 11) may only include the front arms 461 and 471 to contact the first and second sidewalls 321 and 322. In yet other embodiments, the at least one retaining feature 459 may only include the first end front arm 461 in combination with the second end rear arm 491, or only include the first end rear arm 481 in combination with the second end front arm 471. In yet other embodiments, the front arms 461 and 471 may be located at a different location along the body height 393 than the rear arms 481 and 491 and the front arms 461 and 471 may be unaligned with the rear arms 481 and 491. Additionally, in yet other embodiments, the first end arms 461 and 481 may be located at a different location along the body height 393 than the second end arms 471 and 491, and the first end arms 461 and 481 may be unaligned with the second end arms 471 and 491. Such embodiments may be adapted to engage vertical members 102*a* which have irregular sidewalls. In yet other embodiments, arm angles, arm lengths, shapes and dimensions of each of the arms 461, 471, 481 and 491 may be different from that described above. Similarly, in yet other embodiments, arm angles of each of the arms 461, 471, 481 and 491 may be different from each other, arm lengths of each of the arms 461, 471, 481 and 491 may be different from each other and shapes of each of the arms 461, 471, 481 and 491 may be different from each other. Such embodiments may be adapted to retain and position embodiments of the vertical member 102*a* which have irregular or curved sidewalls.

Referring now to FIGS. 16-19, another embodiment of the coupling member 106 is shown generally at 102*b*. The coupling member 106*b* may function as the coupling member 106 for pivotally coupling any one of the vertical members 102 (such as the vertical member 102*a* shown in FIGS. 8 and 9 for example) with the middle and lower horizontal rails 112 and 113 in the barrier system 100 (such as the horizontal rail 110*b* shown in FIGS. 5 and 6 for example). The coupling member 106*b* may also function as the coupling member 106 for pivotally coupling any one of the vertical members 102 to the upper horizontal rail 111' in the barrier system 100' (shown in FIG. 7) having an extended top. Similar to the coupling member 106*a*, the coupling member 106*b* may also be made from plastic materials or composite materials.

A basic structure of the coupling member 106*b* may be similar to the coupling member 106*a* (shown in FIGS. 12-15). In this respect, in the embodiment shown in FIGS. 16-19, the coupling member 106*b* also includes a body 540 and a cover 545. The body 540 may be similar to the body 340 of the coupling member 106*a* (shown in FIGS. 12-15). In this respect, in the embodiment shown, the body 540 is also shaped and dimensioned to be received in the channel 193 of the horizontal rail 110*b* (show in FIGS. 5 and 6) and dimensioned to receive the vertical member 102*a* (shown in FIGS. 8 and 9). The body 540 has a generally rectangular cuboid configuration and a corresponding rectangular cross-section. The body 540 has an upper end 541 and a lower end 542. The rectangular cuboid configuration of the body 540 is formed from a front wall 550, a rear wall 560, a first support 571 and a second support 575. The front wall 550 includes a first end 551 and a second end 552. The rear wall 560 also includes a first end 561 and a second end 562. The first support 571 extends between the first ends 551 and 561 proximate the upper end 541. The second support 575 extends between the second ends 552 and 562, also proximate the upper end 541. The body 540 comprises a body length 590 (shown in FIG. 18), a maximum body width 591, a minimum body width 592, a body height 593 (shown in FIG. 19). In the embodiment shown, the body length 590, the maximum body width 591, the minimum body width 592, and the body height 593 are, respectively, approximately 2.8 cm (1.1 inches), 2.56 cm (1 inches), 1.59 cm (0.625 inches) and 2.41 cm (0.95 inches). In other embodiments, the body length 590, the maximum body width 591, the minimum body width 592, and the body height 593 may be different and may vary depending on dimensions of the horizontal rail 110*b* and the vertical member 102*a*.

The front and rear walls 550 and 560 and the first and second supports 571 and 575 define an aperture 543 shaped and dimensioned to receive the vertical member 102*a*. The aperture 543 may be similar to the aperture 343 of the coupling member 102*a* (shown in FIGS. 12-15). In this respect, in the embodiment shown, the aperture 543 also has a rectangular cross-section corresponding to the rectangular cross-section of the vertical member 102*a*, an aperture length 595 and an aperture width 596 (shown in FIG. 16). For the vertical member 110*a* to be received within the aperture 543, the aperture length 595 and aperture width 596 are greater than, respectively, the length 270 and the width 272 of the vertical member 102*a* (shown in FIGS. 8 and 9). In the embodiment shown, the aperture length 595 and aperture width 596 are, respectively, approximately 2.22 cm (0.875 inches) and 1.59 cm (0.625 inches). In other embodiments, the aperture length 595 and aperture width 596 may be different and may vary depending on dimensions of the vertical member 102*a*. In embodiments where the coupling member 106*b* is to receive a vertical member different from the vertical member 102*a* (such as the vertical member 102*b* having the circular cross-section shown in FIG. 10 or vertical member 102*c* having the triangular cross-section shown in FIG. 11), the body 540 of the coupling member 106*b* may have different components, a different shape and different dimensions, similar to alternative embodiments described in association with the body 340 of the coupling member 106*a*.

In the embodiment shown in FIGS. 16-19, the cover 545 is shaped and dimensioned to rest on top of the body 540 and may facilitate insertion of the vertical member 102*a* into the aperture 543. The cover 545 may be similar to the cover 345 of the coupling member 106*a* (shown in FIGS. 12-15). In this respect, in the embodiment shown, the cover 545 also has a rectangular cross-section and dimensions corresponding to the rectangular cross-section of the body 540 and is coupled to the upper end 541 of the body 540 to cover the front and rear walls 550 and 560 and the first and second supports 571 and 575 without covering the aperture 543. The top cover 545 also includes a curved top surface 546 to urge portions of the vertical member 102*a* contacting the curved top surface 546 to slide into the aperture 543. Similar to the coupling member 106*a*, certain embodiments of the coupling member 106*b* may not include the cover 545 (and may only include the body 540). Additionally, in embodiments where the body 540 is shaped to receive a vertical member different from the vertical member 102*a*, the cover 545 may have a different shape and different dimensions similar to alternative embodiments described in association with the cover 345 of the coupling member 106*a*.

The coupling member 106*b* further includes the at least one positioning feature 600. The at least one positioning feature 600 is configured to engage the at least one horizontal rail 110 (such as the horizontal rail 110*b* shown in FIGS. 5 and 6 for example) to position the coupling member 106*b* at the specific locations along the length of the at least one horizontal rail 110 and to retain the coupling member

106*b* within the channel of the at least one horizontal rail 110 without any welding or any other permanent attachment mechanisms between the coupling member 106*a* and the at least one horizontal rail 110. In the embodiment shown in FIGS. 16-19, the at least one positioning feature 600 is shaped and dimensioned to engage the at least one positioning feature 220 of the horizontal rail 110*b* (shown in FIGS. 5 and 6) to position the coupling member 106*b* along the length 190 and to retain the coupling member 106*a* within the channel 193.

The at least one positioning feature 600 may be similar to the at least one positioning feature 400 of the coupling member 106*a* (shown in FIGS. 12-15). In this respect, in the embodiment shown, the at least one positioning feature 600 also includes a front flange 601 extending from an outer surface of the front wall 550 and a rear flange 605 extending from an outer surface of the rear wall 560. The front and rear flanges 601 and 605 may be similar to the front and rear flanges 401 and 405 of the coupling member 106*a* (shown in FIGS. 12-15). In this respect, in the embodiment shown, the front and rear flanges 601 and 605 may also extend from the outer surfaces of the front and rear walls 550 and 560 at a same location along the body height 593 (best seen in FIG. 19), and are thus aligned with each other. The aligned front and rear flanges 601 and 605 may also be shaped and dimensioned to sufficiently engage, respectively, the front and rear ledges 221 and 225 of the horizontal rail 110*b* (shown in FIGS. 5 and 6). In this respect, the front and rear flanges 601 and 605 are also substantially identical to each other, also have a triangular prism configuration, and also each have, respectively, an extension width 602 and an extension width 606 dimensioned to enable the front and rear flanges 601 and 605 to sufficiently engage the front and rear ledges 221 and 225 to prevent the coupling member 106*b* from falling out of the channel 193. In the embodiment shown, the extension widths 602 and 606 are both approximately 0.229 cm (0.09 inches). In other embodiments, the extension widths 602 and 606 may be different and may vary depending on dimensions of the front and rear ledges 221 and 225 and dimensions of the coupling member 106*a* and the horizontal rail 110*b*.

In other embodiments, the at least one positioning feature 600 may: (1) include front and rear flanges 601 and 605 which have different shapes and different dimensions than that described above; (2) include a front flange 601 which has a shape and a dimension different from a paired rear flange 605; and (3) include unaligned front and rear flanges 601 and 605, all of the above similar to alternative embodiments described in association with the at least one positioning feature 400 of the coupling member 106*a*.

The at least one positioning feature 600 also includes a front positioning projection 611 extending from the front flange 601 and a rear positioning projection 615 extending from the rear flange 605. The front and rear positioning projections 611 and 615 may be similar to the front and rear positioning projections 411 and 415 of the coupling member 106*a* (shown in FIGS. 12-15). In this respect, both the front and rear positioning projections 611 and 615 are also used for retaining and positioning a single coupling member 106*b* at a specific location along the length 190 of the horizontal rail 110*b*, and thus also form a pair of positioning projections. Additionally, the front and rear positioning projections 611 and 615 also both extend at a same location along the body length 590 (best seen in FIG. 17) and are thus also aligned with each other.

The pair of aligned front and rear positioning projections 611 and 615 may be shaped and dimensioned to be received in a corresponding pair of aligned front and rear recesses 223 and 227 of the horizontal rail 110*b* (shown in FIGS. 5 and 6), and engagement of the pair of front and rear positioning projections 611 and 615 with the corresponding pair of front and rear recesses 223 and 227 positions the coupling member 106*b* at the specific location along the length 190 of the horizontal rail 110*a* without any welding or other permanent attachment mechanisms between the coupling member 106*b* and the horizontal rail 110*b*. In the embodiment shown, the front and rear positioning projections 611 and 615 are substantially identical to each other and have a generally rectangular cuboid configuration, with the front positioning projection 611 having a projection width 612 and a projection length 613 and the rear positioning projection 615 having a projection width 616 and a projection length 617. For the pair of front and rear positioning projections 611 and 615 to be received in the pair of front and rear recesses 223 and 227, the projection widths 612 and 616 may be less than the extension widths of the front and rear ledges 221 and 225 and the projection lengths 613 and 617 are less than the lengths of the corresponding pair of front and rear recesses 223 and 227. In the embodiment shown, the projection widths 612 and 616 are the same as the extension widths 602 and 606 of the front and rear flanges 601 and 605 (best seen in FIG. 19) and are thus also both approximately 0.229 cm (0.09 inches) and the projection lengths 613 and 617 are also both approximately 0.483 cm (0.19 inches). In other embodiments, the projection widths and lengths 612, 616, 613 and 617 may be different and may vary depending on dimensions of the corresponding pair of front and rear recesses 223 and 227, of the front and rear ledges 221 and 225, and of the front and rear flanges 601 and 605.

In other embodiments, the at least one positioning feature 600 of the coupling member 106*b* may: (1) include fewer or more pairs of the front and rear positioning projections 611 and 615; (2) only include the front positioning projection 611 (with no rear positioning projection 615) or only include the rear positioning projection 615 (with no front positioning projection 611); (3) include a front positioning projection 611 paired with more than one rear positioning projection 615 and/or include a rear positioning projection 615 paired with more than one front positioning projection 611; (4) include positioning projections having different shapes and different dimensions than that described above; (5) include a front positioning projection 611 which has a different shape and different dimensions than a paired rear positioning projection 615; and (6) include unaligned front and rear positioning projections, all of the above similar to alternative embodiments described in association with the at least one positioning feature 400 of the coupling member 106*a*.

In the embodiment shown in FIG. 16-19, the coupling member 106*b* further includes at least one pivoting feature 630. The at least one pivoting feature 630 is configured to pivotally engage the vertical member 102 (such as the vertical member 102*a* shown in FIGS. 8 and 9 for example) to a specific location along a height of the vertical member 102 without any welding or other permanent attachment mechanisms between the coupling member 106*a* and the vertical member 102 and to allow the vertical member 102 to pivot relative to the coupling member 106*b*. As described above, the at least one positioning feature 600 is configured to position the coupling member 106*b* at a specific location along the length of the at least one horizontal rail 110. The combination of the at least one positioning feature 600 and the at least one pivoting feature 630 thus couple the vertical member 102 to the at least one horizontal rail 110 via the coupling member 106*b* (without any welding or other permanent attachment mechanisms between the coupling member 106*a*, the vertical member 102*a* and the at least one horizontal rail 110*a*) and allows the vertical member 102 to pivot relative to the at least one horizontal rail 110 by pivoting relative to the coupling member 106*b*. The at least one pivoting feature 630 is further configured to retain the vertical member 102 within the aperture 543 and prevent (or restrict/discourage) any upward movement of the vertical member 102 relative to the coupling member 106*b* and the at least one horizontal rail 110. In the embodiment shown in FIGS. 16-19, the at least one pivoting feature 630 is shaped and dimensioned to pivotally engage the corresponding at least one pivoting feature 280 of the vertical member 102*a* (shown in FIGS. 8 and 9).

In the embodiment shown, the at least one pivoting feature 630 comprises a front tab 631 formed in the front wall 550 and a rear tab 641 formed in the rear wall 560. Both the front and rear tabs 631 and 641 cooperate together to engage a corresponding pair of apertures at a same location along the height 271 of the vertical member 102*a* (such as the pair of aligned middle front and rear apertures 282 and 286 or the pair of aligned lower front and rear apertures 283 and 287 of the vertical member 102*a* shown in FIGS. 8 and 9 for example), and thus form a pair of tabs. Additionally, in the embodiment shown, the pair of front and rear tabs 631 and 641 are formed in the front and rear walls 550 and 560 at approximately a same location along the body height 593 and at approximately a same location along the body length 590, and are thus also aligned with each other.

Figure 16:
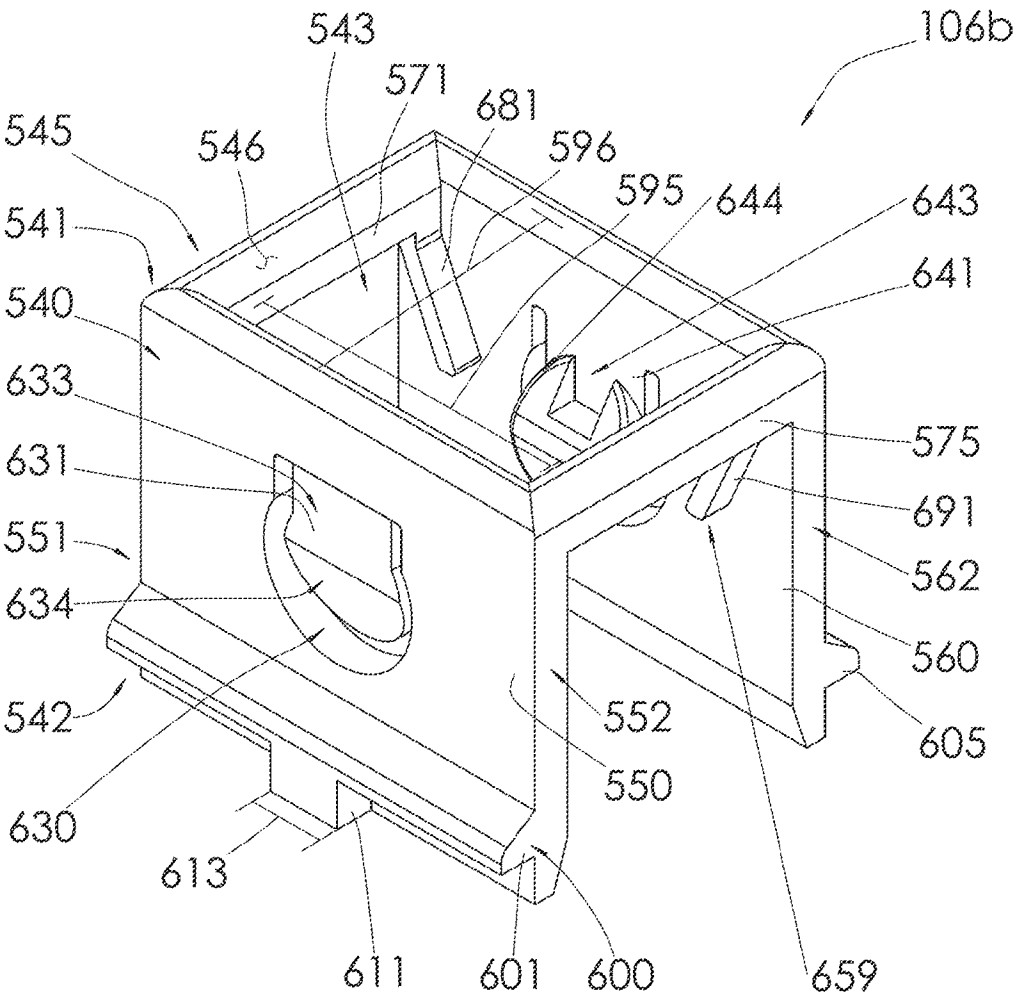
FIG. 16 is a front perspective view of a coupling member of the barrier system of FIG. 1 in accordance with another embodiment.
Figure 17:
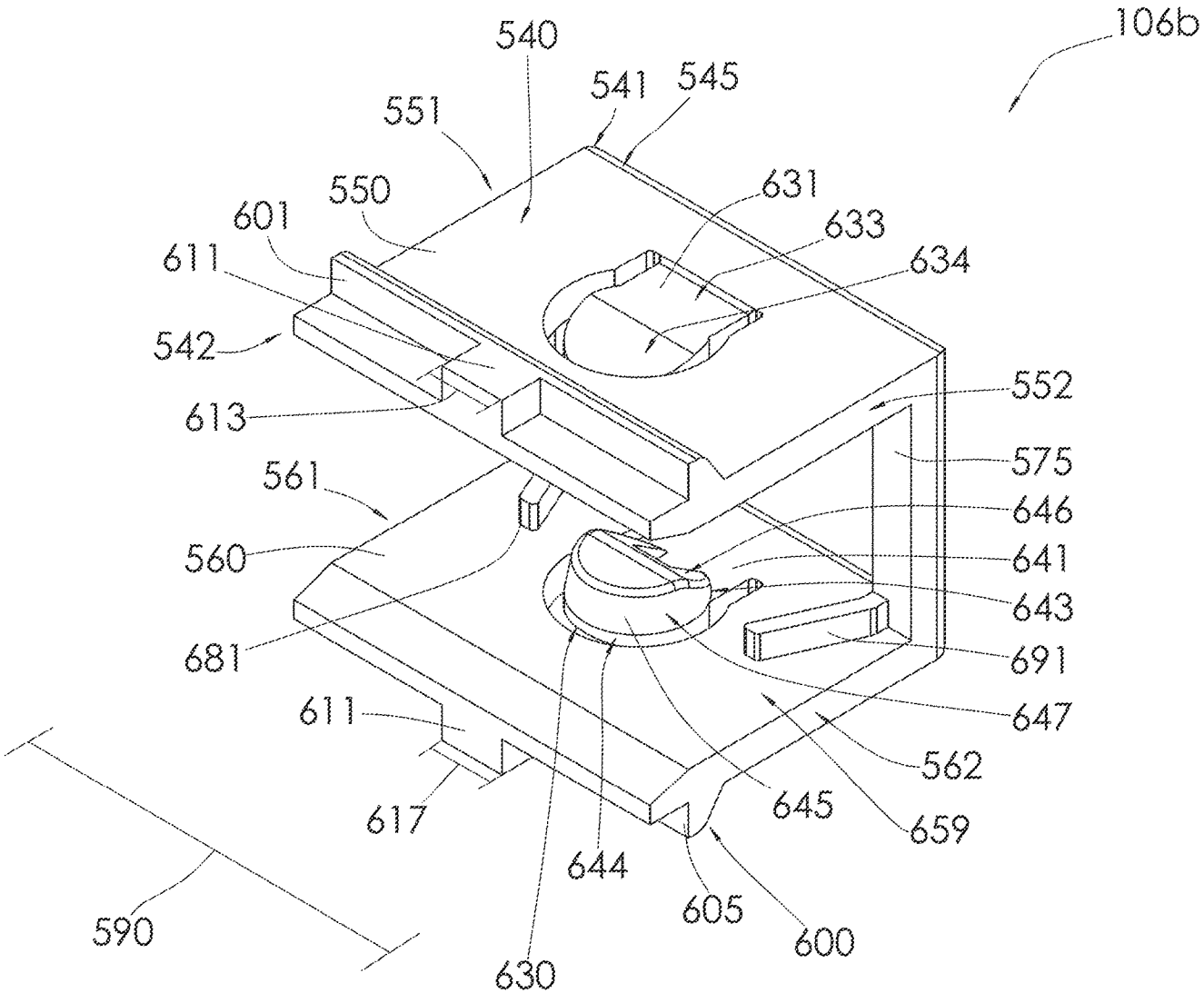
FIG. 17 is a rear perspective view of the coupling member of FIG. 16.

The front tab 631 includes an attachment portion 633 connected to the front wall 550 near the upper end 541 of the body 540 and a deflection portion 634 extending downward toward the lower end 542 from the attachment portion 633, such that the front tab 631 comprises a downward facing tab (best seen in FIGS. 16 and 17). The rear tab 641 has a similar configuration and includes an attachment portion 643 connected to the rear wall 560 near the upper end 541 and a deflection portion 644 extending downward towards the lower end 542 from the attachment portion 643, such that the rear tab 641 also comprises a downward facing tab (best seen in FIGS. 17 and 18). The attachment portions 633 and 643 allow, respectively, the deflection portion 634 to deflect relative to the front wall 550 and the deflection portion 644 to deflect relative to the rear wall 560 when the vertical member 102*a* is inserted into the aperture 543 during assembly of the barrier system 100.

In the embodiment shown, the at least one pivoting feature 630 further includes the front pivoting projection 635 extending from an inner surface of the front tab 631 and the rear pivoting projection 645 extending from an inner surface of the rear tab 641, such that the front and rear pivoting projections 635 and 645 face each other. In this respect, both of the front and rear pivoting projections 635 and 645 cooperate together to engage a corresponding pair of aligned apertures at the same location along the height 271 of the vertical member 102*a*, and thus form a pair of pivoting projections. Additionally, the front and rear pivoting projections 635 and 645 extend from the aligned front and rear tabs 631 and 641 and are thus located in the front and rear walls 550 and 560 at approximately a same location along the body height 593 and at approximately a same location along the body length 590, and are thus also themselves aligned with each other.

The front pivoting projection 635 is shaped and dimensioned to be pivotally received within a front aperture in the front wall 261 of the vertical member 102*a* (such as the middle and lower front apertures 282 and 283 shown in FIG. 8 for example). The rear pivoting projection 645 is shaped and dimensioned to be pivotally received in a rear aperture in the rear wall 265 of the vertical member 102*a* (such as the middle and lower rear apertures 286 and 287 shown in FIG. 8 for example). In the embodiment shown, the front and rear pivoting projections 635 and 645 both have a generally cylindrical configuration and a diameter. This cylindrical configuration allows the front and rear pivoting projections 635 and 645 to be pivotally received in the front and rear apertures 282 and 286 (or 283 and 287) having the corresponding circular cross-section. For the front and rear pivoting projections 635 and 645 to be pivotally received within, respectively, the front and rear apertures 282 and 286 (or 283 and 287), the diameter of the front pivoting projection 635 is less than a diameter of the front aperture 282 (or 283), and the diameter of the rear pivoting projection 645 is less than a diameter of the rear aperture 286 (or 287). In the embodiment shown, the diameter of the front and rear pivoting projections 635 and 645 are both approximately 0.813 cm (0.32 inches). In other embodiments, the diameter of the front and rear pivoting projections 635 and 645 may be different and may vary depending on a diameter of the front and rear apertures of the vertical member 102*a*.

Figure 18:
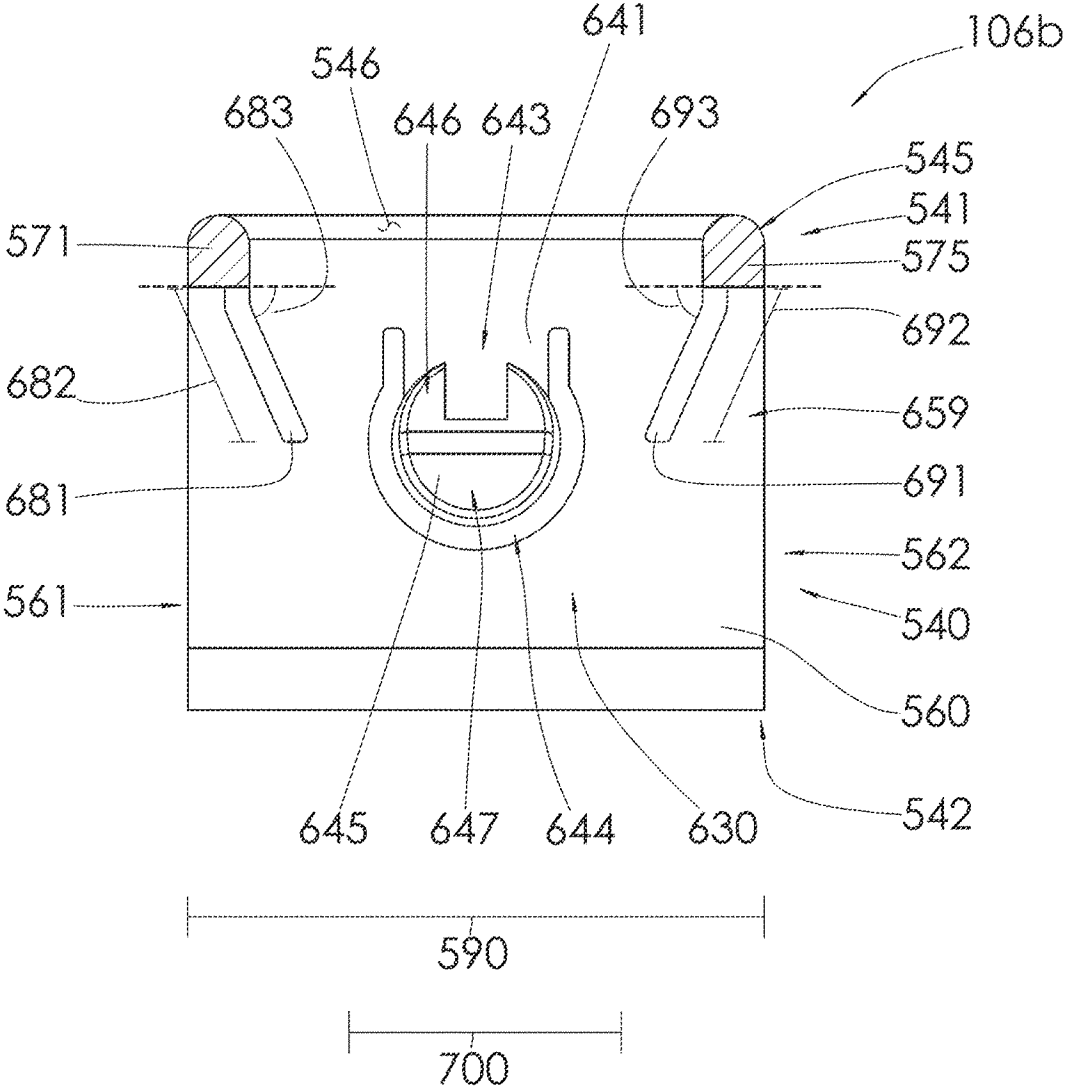
FIG. 18 is a sectional view of the coupling member of FIG. 16.
Figure 19:
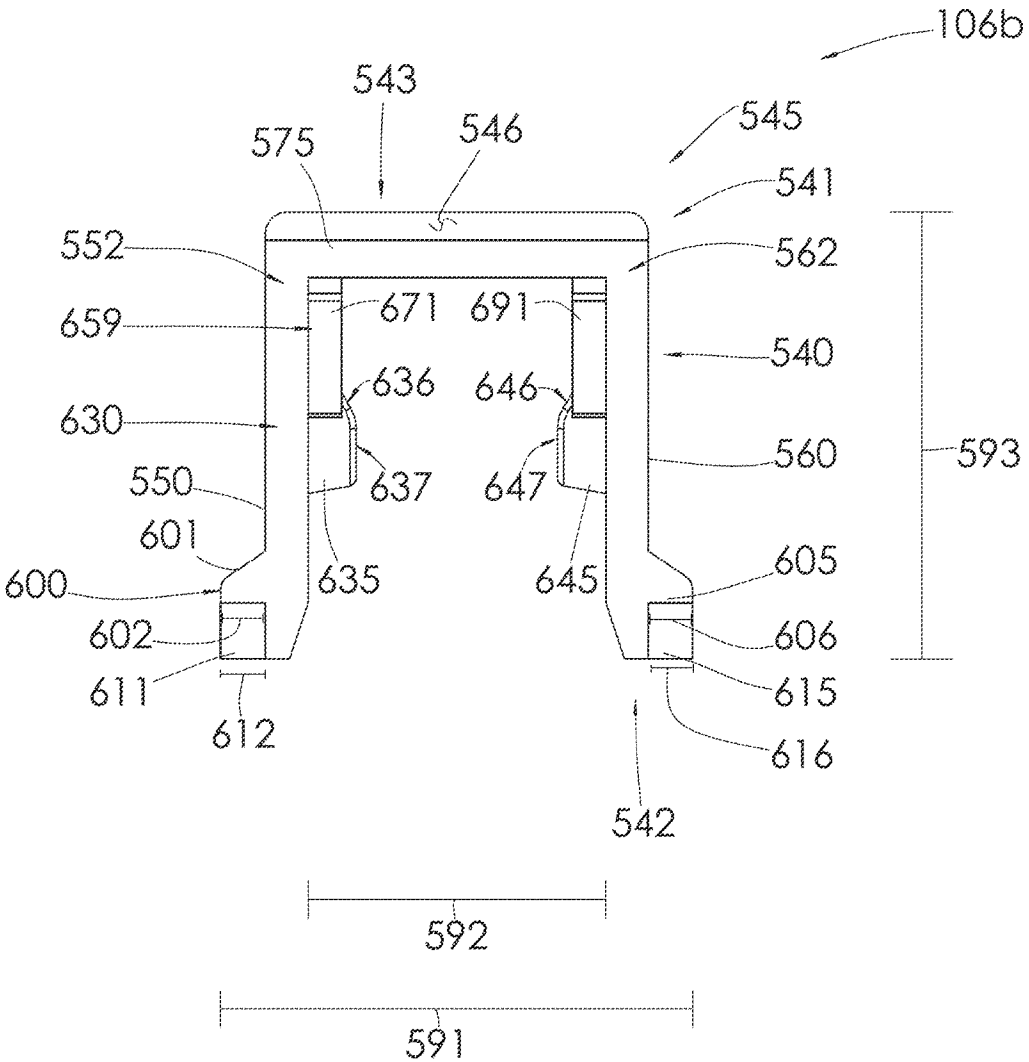
FIG. 19 is an end view of the coupling member of FIG. 16.

In the embodiment shown, the front pivoting projection 635 includes a downwardly sloped portion 636 extending from the attachment portion 633 and a retaining portion 637 extending from the deflection portion 634 (best seen in FIG. 19). Similarly, the rear pivoting projection 645 also includes a downwardly sloped portion 646 extending from the attachment portion 643 and a retaining portion 647 extending from the deflection portion 644 (best seen in FIGS. 17-19). A width of the downwardly sloped portions 636 and 646 increases from the attachment portions 633 and 643 until it becomes a width of the retaining portions 637 and 647. The smaller width of the downwardly sloped portions 636 and 646 may facilitate insertion of, respectively, the front pivoting projection 635 into the front aperture 282 (or 283) and the rear pivoting projection 645 into the rear aperture 286 (or 287) during assembly of the barrier system 100. The larger width of the retaining portions 637 and 647 may securely engage the front and rear pivoting projections 635 and 645 in, respectively, the front and rear apertures 282 and 286 (or 283 and 287) when the barrier system 100 is assembled. In the embodiment shown, the width of the retaining portions 637 and 647 are both approximately 0.305 cm (0.12 inches). In other embodiments, the width of the retaining portions 637 and 647 may be different and may vary depending on dimensions of the corresponding apertures 282 and 286 and a thickness of the front and rear walls 261 and 265 of the vertical member 102*a*. The combination of the downward facing front and rear tabs 631 and 641 and the downwardly sloped front and rear pivoting projections 635 and 645 may enable insertion of the vertical member 102*a* into the aperture 543 from the upper end 541 towards the lower end 542 of the body 540 while preventing (or restricting or discouraging) any movement of an inserted and engaged vertical member 102*a* out of the aperture 543 upward from the upper end 541, and may make the coupling member 106*b* single-track (insertion possible downwards from the upper end 541 towards the lower end 542, but not vice versa). Preventing (or restricting and discouraging) upward movement of the vertical member 102*a* can improve stability of the barrier system 100 when assembled and when racking to change the angle 103 (see FIGS. 1 and 2).

In other embodiments, the at least one pivoting feature 630 may: (1) only include the front tab 631 and the front pivoting projection 635 (with no rear tab 641 or rear pivoting projection 645) or only include the rear tab 641 or rear pivoting projection 645 (with no front tab 631 or front pivoting projection 635); (2) include front and rear pivoting projections 635 and 645 which extend directly from the front and rear walls 550 and 560 (with no front and rear tabs 631 and 641); (3) include front and rear pivoting projections 635 and 645 with different configurations for the sloped and retaining portions; (4) include front and rear pivoting projections 635 and 645 having different shapes and different dimensions that described above; (5) include front and rear tabs 631 and 641 having different shapes and different dimensions in that described above; (6) include a front tab 631 having a different shape and dimensions than a paired rear tab 641; (7) include a front pivoting projection 635 having a different shape and dimensions than a paired rear pivoting projection 645; and (8) include unaligned front and rear pivoting projections 635 and 645, all of the above similar to the alternative embodiments described in association with the at least one pivoting feature 430 of the coupling member 106*a*.

The coupling member 106*b* further includes at least one retaining feature 659. The at least one retaining feature 659 is configured to contact at least one sidewall of the vertical member 102 (such as the first and second sidewalls 262 and 265 of the vertical member 102*a* shown in FIGS. 8 and 9 for example) received in the aperture 543. The at least one retaining feature 659 cooperates with the at least one pivoting feature 630 to retain the vertical member 102 within the aperture 543 and prevent (or restrict/discourage) any upward movement of the vertical member 102 relative to the coupling member 106*a* and the at least one horizontal rail 110. In the embodiment shown in FIGS. 16-19, the at least one retaining feature 659 is shaped and dimensioned to contact the first and second sidewalls 262 and 266 of the vertical member 102*a* when the vertical member 102*a* is received in the aperture 543.

In the embodiment shown, the at least one retaining feature 659 comprises a first end front arm 661 extending from an inner surface of the first support 571 proximate an end of the first 10 support 571 coupled to the front wall 550 and a second end front arm 671 extending from an inner surface of the second support 575 proximate an end of the second support 575 coupled to the front wall 550. The first end front arm 661 and the second end front arm 671 thus both extend proximate the front wall 650 and are mirror images of each other. The at least one retaining feature 659 further comprises a first end rear arm 681 extending from the inner surface of the first support 571 proximate an end of the first support 571 coupled to the rear wall 560, and a second end rear arm 691 extending from the inner surface of the second support 575 proximate an end of the second support 575 coupled to the rear wall 560. The first end rear arm 681 and the second end rear arm 691 thus both extend proximate the rear wall 560 and are mirror images of each other. All of the arms 661, 671, 681 and 691 may cooperate together to engage the first and second sidewalls 262 and 266 at a same location along the height 271 of the vertical member 102*a*, and thus form a set of arms. Additionally, each of the arms 661, 671, 681 and 691 may extend to approximately a same location along the body height 593 and are thus also aligned with each other.

Each of the arms 661, 671, 681 and 691 may be substantially identical to each other and all have a generally rectangular cuboid configuration. Each of the arms 661, 671, 681 and 691 have a respective arm length (arm length 682 of the first end rear arm 681 and arm length 692 of the second end rear arm 691 are shown in FIG. 18). Each of the arms 661, 671, 681 and 691 also extend from the corresponding first and second supports 571 and 575 inward and downward towards the lower end 542 at a respective arm angle relative to a horizontal of the body 540 (arm angle 683 of the first end rear arm 681 and arm angle 693 of the second end rear arm 691 are shown in FIG. 18). The respective arm lengths and respective arm angles of each of the arms 661, 671, 681 and 691 may be dimensioned such that a respective contact surface of the first end arms 661 and 681 are positioned to contact the first sidewall 262 of the vertical member 102*a* and a respective contact surface of the second end arms 671 and 691 are positioned to contact the second sidewall 266 of the vertical member 102*a* when the vertical member 102*a* is received within the aperture 543. In this respect, the respective arm lengths and respective arm angles of each of the arms 661, 671, 681 and 691 may be dimensioned such that a separation distance 700 (shown in FIG. 18) between the first and second end front arms 661 and 671 and between the first and second and rear arms 681 and 691 is less than the length 270 of the vertical member 102*a* (shown in FIGS. 8 and 9). Additionally, the respective arm lengths and respective arm angles of each of the arms 661, 671, 681 and 691 may also be dimensioned to centre the vertical member 102*a* relative to at least one of the aperture length 595 and width 596 when the vertical member 102*a* is inserted within the aperture 543 to facilitate assembly of the barrier system 100, as the aperture length 595 and/or width 596 may be greater than, respectively, the length 270 and/or width 272 of the vertical member 102*a*. In the embodiment shown, the arm length of each of the arms 661, 671, 681 and 691 is approximately 0.95 cm (0.37 inches). Similarly, in the embodiment shown, the arm angle of each of the arms 661, 671, 681 and 691 is approximately 30°. In other embodiments, the arm angle and arm length of each of the arms 661, 671, 681 and 691 may be different and may vary depending on dimensions of the vertical member 102*a* relative to dimensions of the coupling member 106*b*. For example, the arm length of each of the arms 661, 671, 681 and 691 may range between approximately 0.05 cm (0.02 inches) and approximately 2 cm (0.78 inches): similarly, the arm angle of each of the arms 661, 671, 681 and 691 may range between approximately 5° and approximately 85°.

Still referring to FIGS. 16-19, a connection point between the arms 661, 671, 681 and 691 and the respective first and second supports 571 and 575 may form a hinge point at which the arms 661, 671, 681 and 691 are adapted to deflect relative to the first and second supports 571 and 575. The hinge points may be a living hinge comprising an area of reduced material or more flexible material. When the vertical member 102*a* is inserted into the aperture 543, the arms 661, 671, 681 and 691 may be deflected by the first and second sidewalls 262 and 266 at the respective hinge points and the respective arm angles may change. The inward extension of the arms 661, 671, 681 and 691 may bias the arms 661, 671, 681 and 691 to continually contact the first and second sidewalls 262 and 265 of the vertical member 102*a*, and this contact may help retain the inserted vertical member 102*a* within the aperture 543. The downward extension of the arms 661, 671, 681 and 691 may cooperate together with the downward facing front and rear tabs 631 and 641 and the downwardly sloped front and rear pivoting projections 635 and 645 to enable insertion of the vertical member 102*a* into the aperture 543 from the upper end 541 towards the lower end 542 of the body 540 while preventing (or restricting or discouraging) any movement of an inserted and engaged vertical member 102*a* out of the aperture 543 upward from the upper end 541 to make the coupling member 106*a* single-track (insertion possible downwards from the upper end 541 towards the lower end 542, but not vice versa). As noted above, preventing (or restricting or discouraging) upward movement of the vertical member 102*a* can improve stability of the barrier system 100 when assembled and when racking.

In other embodiments, the at least one retaining feature 659 may include fewer arms or more arms similar to the alternative embodiments described above in association with the at least one retaining feature 459 of the coupling member 106*a*. Additionally, in other embodiments, the at least one retaining feature 630 may only include a single first end arm extending from the inner surface of the first support 571 at a location near a middle of the minimum body width 592 and only a single second end arm extending from the inner surface of the second support 575 also at the location near the middle of the minimum body width 592. In other embodiments, the at least one retaining feature 659 may include more than two first end arms extending from the first support 571 and may include more than two second end arms extending from the second support 575. In other embodiments, the at least one retaining feature 659 may: (1) include front arms 661 and 671 which are unaligned with the rear arms 681 and 691; (2) include first end arms 661 and 681 which are unaligned with the second end arms 671 and 691; (3) include arms 661, 671, 681 and 691 having arm angles, arm lengths and shapes which are different from that described above; (4) include arms 661, 671, 681 and 691 having arm angles that are different from each other; (5) include arms 661, 671, 681 and 691 having arm lengths that are different from each other; and (6) include arms 661, 671, 681 and 691 having shapes that are different from each other, all of the above similar to alternative embodiments described in association with the at least one retaining feature 459 of the coupling member 106*a*.

Figure 20:
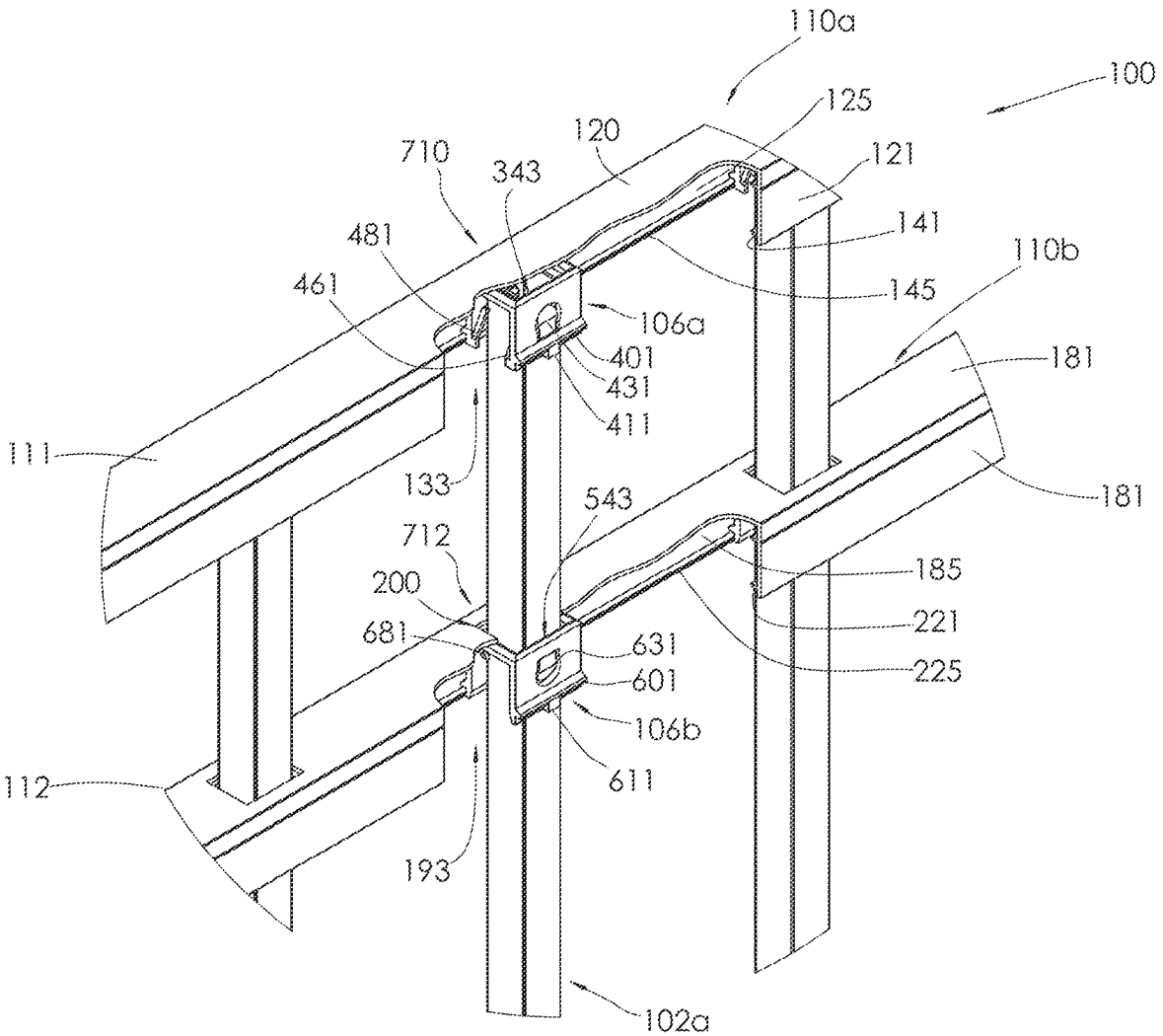
FIG. 20 is a perspective and partial sectional view of top and middle horizontal rails of the barrier system of FIG. 1 in accordance with one embodiment.
Figure 21:
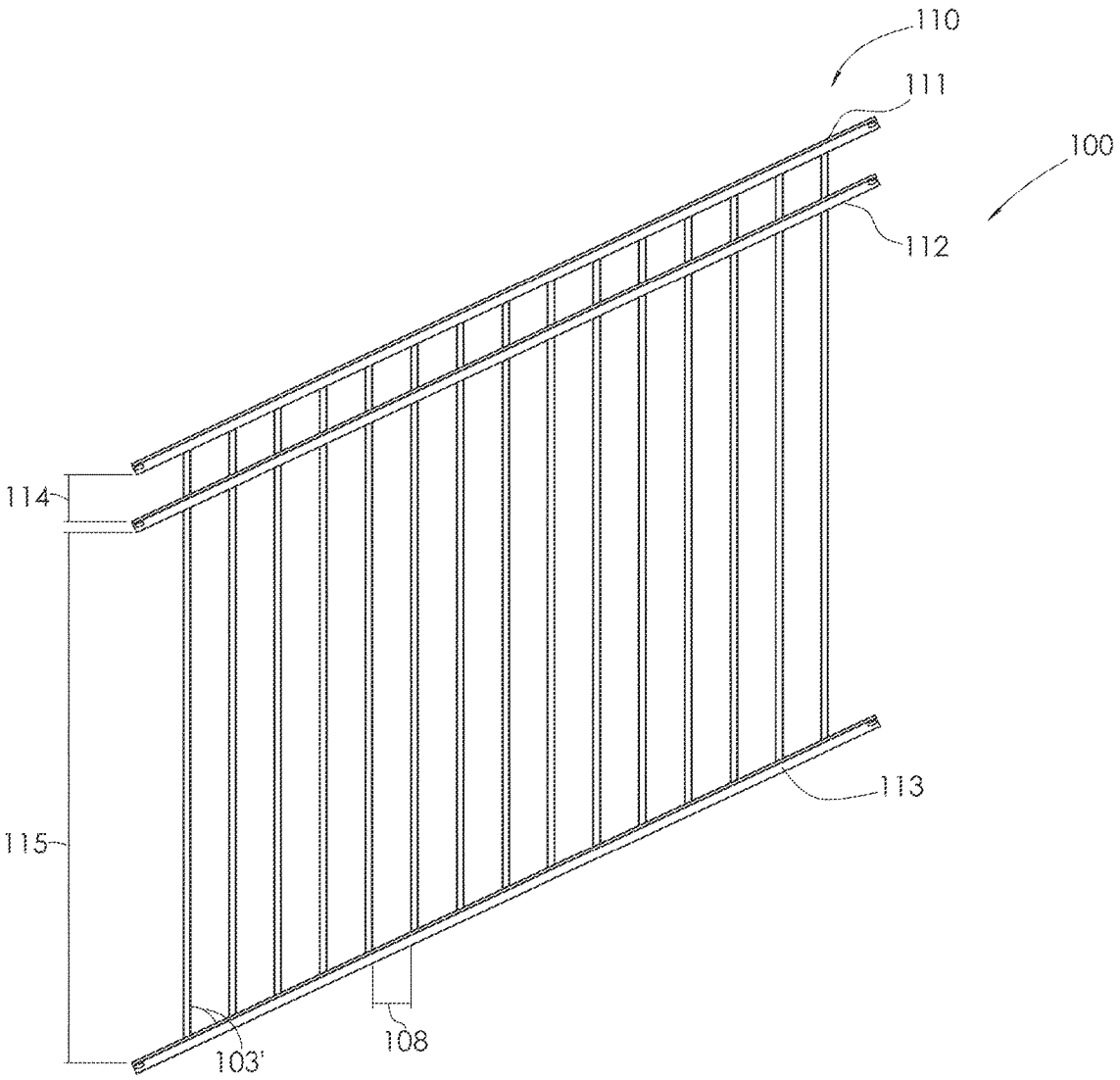
FIG. 21 is a front elevation view of the barrier system of FIG. 1 in a racked configuration.

Referring now to FIG. 20, a broken view of the upper horizontal rail 111 and the middle horizontal rail 112 coupled to the vertical members 102 is generally shown. In the embodiment shown, the coupling member 106*a* (shown in FIGS. 12-15) pivotally couples the vertical member 102*a* to the upper horizontal rail 111 without any welding or other permanent attachment mechanisms between the coupling member 102*a*, the upper horizontal rail 111 and the vertical member 102*a*. Similarly, the coupling member 106*b* (shown in FIG. 16-19) pivotally couples the vertical member 102*a* to the middle horizontal rail 112 without any welding or other permanent attachment mechanisms between the coupling member 106*b*, the middle horizontal rail 112 and the vertical member 102*a*. Although not shown in FIG. 20, the coupling member 106*b* may also pivotally couple the vertical member 102*a* to the lower horizontal rail 113 (shown in FIG. 1). In the embodiment shown, the upper horizontal rail 111 comprises the horizontal rail 110*a* shown in FIGS. 2-4 and the middle horizontal rail 112 comprises the horizontal rail 110*b* shown in FIGS. 5 and 6.

In the embodiment shown, the coupling member 106*a* is retained within the channel 133 and positioned at a specific location 710 along the length 130 of the horizontal rail 110*a*. The specific location 710 corresponds to a location along the length 130 where a pair of front and rear recesses 143 and 147 are located within, respectively, the front and rear ledges 141 and 145. The pair of front and rear recesses 143 and 147 receive the front and rear positioning projections 411 and 415 of the coupling member 106*a* to retain and position the coupling member 106*a* at the specific location 710 without any welding or other permanent attachment mechanisms between the coupling member 106*a* and the horizontal rail 110*a*. Additionally, in the embodiment shown, when the coupling member 106*a* is positioned at the specific location 710, the front and rear ribs 161 and 165 of the horizontal rail 110*a* contact the front and rear walls 350 and 360 of the coupling member 106*a*, to reduce movement of the coupling member 106*a* within the channel 133.

Similarly, in the embodiment shown, the coupling member 106*b* is retained within the channel 193 and positioned at a corresponding specific location 712 along the length 190 of the horizontal rail 110*b*. The specific location 712 corresponds to a location along the length 190 that: (1) a pair of front and rear recesses 223 and 227 are located within, respectively, the front and rear ledges 221 and 225, and (2) one of the apertures 200 is located within the top wall 180 of the horizontal rail 110*b*. The pair of front and rear recesses 223 and 227 receive the front and rear positioning projections 611 and 615 of the coupling member 106*b* to retain and position the coupling member 106*b* at the specific location 712 without any welding or other permanent attachment mechanisms between the coupling member 106*b* and the horizontal rail 110*b*. Additionally, in the embodiment shown, when the coupling member 106*b* is positioned at the specific location 712, the front and rear ribs 241 and 245 of the horizontal rail 110*a* contact the front and rear walls 550 and 560 of the coupling member 106*b*, to reduce movement of the coupling member 106*a* within the channel 133.

Additionally, as the coupling members 106*a* and 106*b* themselves each retain the vertical member 102*a* in their respective apertures 343 and 543 (described in greater detail below), the specific locations 710 and 712 also correspond to a location along the lengths 130 and 190 of the horizontal rails 110*a* and 110*a* that the vertical member 102*a* is to be located in the barrier system 100. In this respect, in the embodiment shown, the vertical member 102*a* is retained in the aperture 343 of the coupling member 106*a*, and the upwardly sloping front and rear pivoting projections 435 and 445 extending from the upward facing front and rear tabs 431 and 441 of the coupling member 106*a* pivotally engage the upper front and rear apertures 281 and 285 formed in the front and rear walls 261 and 265 of the vertical member 102*a*. This pivotal engagement pivotally couples the coupling member 106*a* and the vertical member 102*a* without any welding or other permanent attachment mechanisms between the coupling member 106*a* and the vertical member 102*a*. As noted above, the pivotal engagement of the coupling member 106*a* and the vertical member 102*a* in combination with the retention of the coupling member 106*a* relative to the horizontal rail 110*a* enables the vertical member 102*a* to also pivot relative to the horizontal rail 110*a*, again without any welding or other permanent attachment mechanisms between any of the coupling member 106*a*, the horizontal rail 110*a* and the vertical member 102*a*. Additionally, the upward and inward extending first end arms 461 and 481 of the coupling member 106*a* contact the first sidewall 262 of the vertical member 102*a* and the upward and inward extending second end arms 471 and 491 contact the second sidewall 266 of the vertical member 102*a*. The combination of the upward facing front and rear tabs 431 and 441 and upward sloping front and rear projections 435 and 445 engaging the front and rear apertures 281 and 285 in the front and rear walls 261 and 265 and the upward and inward extending arms 461, 471, 481 and 491 engaging first and second sidewalls 262 and 266 may more securely retain the vertical member 102*a* within the aperture 343 and prevent (or restrict/discourage) any downward movement of the vertical member 102*a* relative to the coupling member 106*a* and the horizontal rail 110*a*.

Correspondingly, the vertical member 102*a* is also retained in the aperture 543 of the coupling member 106*b*, with the downwardly sloping front and rear pivoting projection 635 and 645 extending from the downward facing front and rear tabs 631 and 641 of the coupling member 106*b* pivotally engaging the middle front and rear apertures 282 and 286 formed in the front and rear walls 261 and 265 of the vertical member 102*a*. This pivotal engagement couples the coupling member 106*b* and the vertical member 102*a* without any welding or other permanent attachment mechanisms between the coupling member 106*b* and the vertical member 102*a*. As noted above, the pivotal engagement of the coupling member 106*b* and the vertical member 102*a* in combination with the retention of the coupling member 106*b* relative to the horizontal rail 110*b* enables the vertical member 102*a* to also pivot relative to the horizontal rail 110*b*, again without any welding or other permanent attachment mechanisms between any of the coupling member 106*b*, the horizontal rail 110*b* and the vertical member 102*a*. Additionally, the downward and inward extending first end arms 661 and 681 of the coupling member 106*b* contact the first sidewall 262 of the vertical member 102*a* and the downward and inward extending second end arms 671 and 691 of the coupling member 106*b* contact the second sidewall 266 of the vertical member 102*a*. The combination of the downward facing front and rear tabs 631 and 641 and downward sloping front and rear pivoting projections 635 and 645 engaging the front and rear apertures 282 and 286 (or 283 and 287) in the front and rear walls 261 and 265 and the downward and inward extending arms 661, 671, 681 and 691 engaging first and second sidewalls 262 and 266 may more securely retain the vertical member 102*a* within the aperture 543 and prevent (or restrict/discourage) any upward movement of the vertical member 102*a* relative to the coupling member 106*b* and the horizontal rail 110.

The at least one pivoting features 430 and 630 and the at least one retaining features 459 and 659 of the coupling members 106*a* and 106*b* cooperate together to provide greater stability to the barrier system 100 when assembled and when racking. In this respect, the upward facing front and rear tabs 431 and 441, the upwardly sloping front and rear projections 435 and 445 and the upward and inward extending arms 461, 471, 481 and 491 of the coupling member 106*a* may prevent (or restrict/discourage) downward movement of the vertical member 102*a* relative to the coupling member 106*a* and the horizontal rail 110*a*, while the downward facing front and rear tabs 631 and 641, downwardly sloping front and rear pivoting projections 635 and 645 and the downward and inward extending arms 661, 671, 681 and 691 of the coupling member 106*b* may prevent (or restrict/discourage) any upward movement of the vertical member 102*a* relative to the coupling member 106*b* and the horizontal rail 110*b*. The combination of the coupling member 106*a* and 106*b* in one barrier system 100 cooperate prevent any upwards or downwards movement of the vertical member 102*a* relative to the horizontal rails 110*a* and 110*b*, which improved the stability of the barrier system 100 when assembled and when racked.

Figure 22:
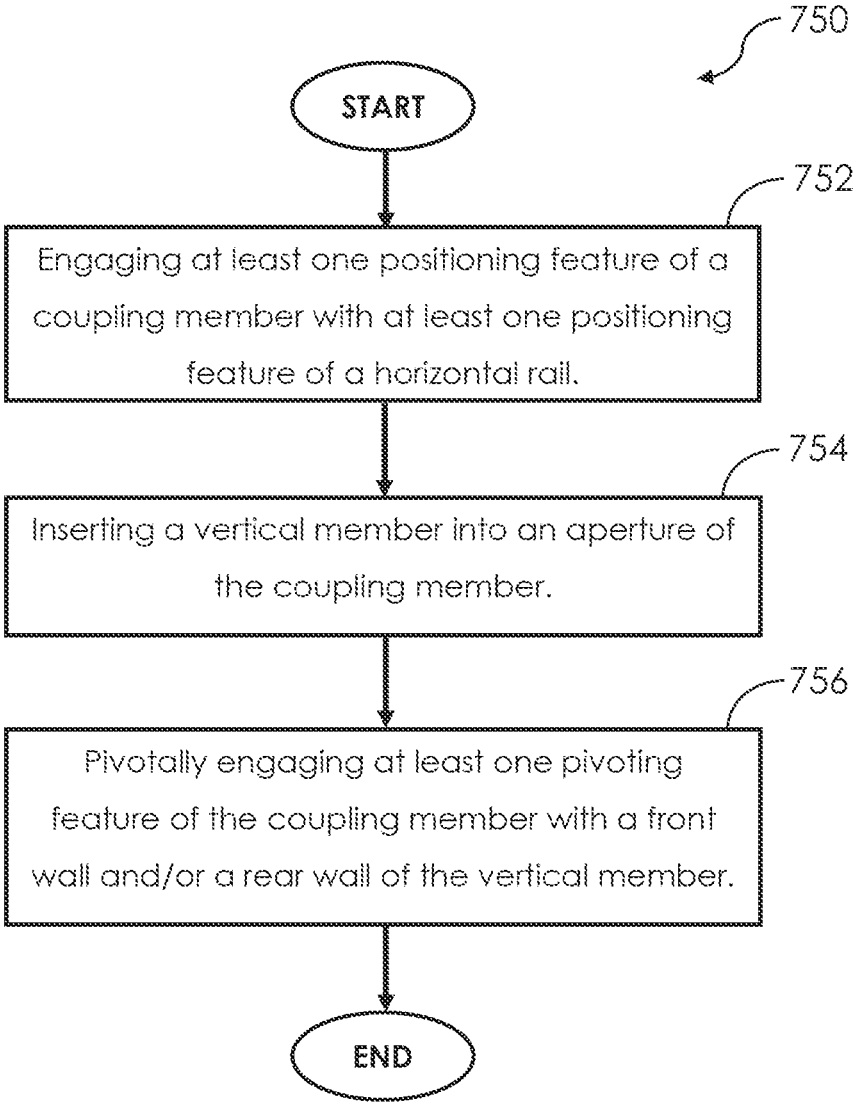
FIG. 22 is a schematic of a method of assembly of the barrier system of FIG. 1 in accordance with one embodiment.

Referring to FIG. 22, a method of assembly of a barrier system (such as the barrier system 100 shown in FIG. 1 or the barrier system 100' shown in FIG. 7) is generally shown at 750. The method 750 involves engaging the at least one positioning feature of the coupling member 106 with the corresponding at least one positioning feature of the at least one horizontal rail 110 (block 752).

In certain embodiments, block 752 may involve inserting one or more of the coupling member 106*a* into the channel 133 of the horizontal rail 110*a* (forming the upper horizontal rail 111), contacting the front and rear ledges 141 and 145 of the horizontal rail 110*a* with, respectively, the front and rear flanges 401 and 405 of the coupling member 106*a*, and then sliding the coupling member 106*a* along the front and rear ledges 141 and 145 until the pair of front and rear positioning projections 411 and 415 of the at least one positioning feature 400 of the coupling member 106*a* are inserted into, respectively, a corresponding pair of front and rear recesses 143 and 147 of the at least one positioning feature 140 of the horizontal rail 110*a*. Contact of the front and rear ledges 141 and 145 with the front and rear flanges 401 and 405 may retain the coupling member 106*a* within the channel 133 of the horizontal rail 110*a*. Engagement of the front and rear positioning projections 411 and 415 in the corresponding pair of front and rear recesses 143 and 147 may position the coupling member 106*a* at a specific location (such as the specific location 710 shown in FIG. 20) along the length 130 (corresponding to a desired location of the vertical members 102) and prevent movement of the coupling member 106*a* along the length 130 away from that specific location.

Block 752 may further optionally involve contacting the front and rear walls 350 and 360 of the coupling member 106*a* with the front and rear ribs 161 and 165 of the at least one contacting feature 160 of the horizontal rail 110*a*. Contacting the front and rear walls 350 and 360 with the front and rear ribs 161 and 165 may reduce movement of the coupling member 106*a* within the channel 133, particularly any lateral movement along the width 132.

In certain embodiments, block 752 may further involve inserting one or more of the coupling member 106*b* into the channel 193 of the horizontal rail 110*b* (forming one or more of the upper, middle and lower horizontal rails 111, 112 and 113), contacting the front and rear ledges 221 and 225 of the horizontal rail 110*b* with, respectively, the front and rear flanges 601 and 605 of the coupling member 106*b*, and then sliding the coupling member 106*b* along the front and rear ledges 221 and 225 until the pair of the front and rear positioning projections 611 and 615 of the at least one positioning feature 600 of the coupling member 106*b* are inserted into, respectively, a corresponding pair of front and rear recesses 223 and 227 of the at least one positioning feature 220 of the horizontal rail 110*b*. Similar to that described in association with the coupling member 106*a* and the horizontal rail 110*a*, the above steps may retain the coupling member 106*b* within the channel 193, position the coupling member 106*b* at a specific location (such as the specific location 712 shown in FIG. 20) along the length 190 of the horizontal rail 110*b* and prevent movement of the coupling member 106*b* along the length 190 away from the specific location.

Block 752 may further optionally involve contacting the front and rear walls 550 and 560 of the coupling member 106*b* with the front and rear ribs 241 and 245 of the at least one contacting feature 240 of the horizontal rail 110*b*. Similar to that described in association with coupling member 106*a* and horizontal rail 110*a*, this optional step may reduce movement of the coupling member 106*a* within the channel 193, and particularly any lateral movement along the width 192.

The method 750 further involves inserting the vertical member 102 into the at least one coupling member 106 (block 754). In certain embodiment shown, block 754 may involve inserting the upper end 273 of vertical member 102*a* into an open end of the channel 133 of the horizontal member 110*a* and into the aperture 343 of the coupling member 106*a* from the lower end 342 towards the upper end 341 of the body 340. In certain embodiments, block 754 may further involve inserting the lower end 274 of the vertical member 102*a* through one of the apertures 200 in the top wall 180 of the horizontal rail 110*b*, then into the aperture 543 of the coupling member 106*b* from the upper end 541 toward the lower end 542 of the body 540, and then through an open end of the channel 193 of the horizontal member 110*b*.

The method 750 further involves pivotally engaging at least one pivoting feature of the at least one coupling member 106 with at least one of a front wall and a rear wall of the vertical member 102 to pivotally couple the vertical member 102 with the coupling member 106 and to allow the vertical member 102 to pivot relative to the at least one horizontal rail 110 (block 756). Pivotally engaging the at least one pivoting feature of the least one coupling member 106 with the at least one of the front and rear walls of the vertical member 102 may also cause at least one retaining feature of the at least one coupling member 106 to contact a sidewall of the vertical member 102.

In certain embodiments, block 756 may involve pivotally engaging the at least one pivoting feature 430 of the coupling member 106*a* with the at least one pivoting feature 280 of the vertical member 102*a*. Specifically, in the embodiment shown, when the upper end 273 of the vertical member 102*a* is inserted into the aperture 343 of the coupling member 106*a* from the lower end 342 of the body 340: (1) the front wall 261 of the vertical member 102*a* may contact the front pivoting projection 435 of the coupling member 106*a* and may deflect the upward facing front tab 431 outwards relative to the front wall 350 of the coupling member 106*a* until the front pivoting projection 435 is received within the upper front aperture 281 in the front wall 261; and (2) the rear wall 265 of the vertical member 102*a* may contact the rear pivoting projection 445 of the coupling member 106*a* and may deflect the upward facing rear tab 441 outwards relative to the rear wall 360 of the coupling member 106*a* until the rear pivoting projection 445 is received within the upper rear aperture 285 formed in the rear wall 265. Receiving the pivoting projections 435 and 445 within corresponding the apertures 281 and 285 pivotally couples the coupling member 106*a* and the vertical member 102*a*, retains the vertical member 102*a* within the aperture 343 and prevents (or restrict or discourages) any downward movement of the vertical member 102*a* relative to the coupling member 106*a*.

Additionally, pivotally engaging the at least one pivoting feature 430 of the coupling member 106*a* with the at least one pivoting feature 280 of the vertical member 102*a* may further cause the at least one retaining feature 459 of the coupling member 106*a* to contact the first and second sidewalls 262 and 266 of the vertical member 102*a*. Specifically, in the embodiment shown, when the vertical member 102*a* is inserted into the aperture 343 of the coupling member 106*a*: (1) the first sidewall 262 of the vertical member 102*a* may contact the contact surfaces of the inward and upward extending first end arms 461 and 481 of the coupling member 106*a*, and may deflect the first end arms 461 and 481 at their respective hinge points outward; and (2) the second sidewall 266 of the vertical member 102*a* may contact the contact surfaces of the inward and upward extending second end arms 471 and 491 of the coupling member 106*a* and may deflect the second end arms 471 and 491 at their respective hinge points outward. Contacting the first sidewall 262 with the first end arms 461 and 481 and the second sidewall 266 with the second end arms 471 and 491 may further retain the vertical member 102*a* within the aperture 343, may centre the vertical member 102*a* within the aperture 343 and may further prevent (or restrict/discourage) any downward movement of the vertical member 102*a* relative to the coupling member 106*a*.

In certain embodiments, block 756 may also involve pivotally engaging the at least one pivoting feature 630 of the coupling member 106*b* and the at least one pivoting feature 280 of the vertical member 102*a*. Specifically, in the embodiment shown, when the lower end 274 of the vertical member 102*a* is inserted into the aperture 543 of the coupling member 106*b* from the upper end 541 of the body 540: (1) the front wall 261 of the vertical member 102*a* may initially contact the front pivoting projection 635 and may deflect the downward facing front tab 631 outwards relative to the front wall 550 of the coupling member 106*b*, until the front pivoting projection 635 is received within the one of the middle and lower front apertures 282 and 283 in the front wall 261; and (2) the rear wall 265 of the vertical member 102*a* may initially contact the rear pivoting projection 645 and may deflect the downward facing rear tab 641 outwards relative to the rear wall 560 of the coupling member 106*b*, until the rear pivoting projection 645 is received within one of the lower and middle rear apertures 286 and 287 formed in the rear wall 265. Similar to that described in association with coupling member 106*a*, the above step pivotally couples the coupling member 106*b* and the vertical member 102*a*, retains the vertical member 102*a* within the aperture 543 and may prevent (or restrict/discourage) any upward movement of the vertical member 102*a* relative to the coupling member 106*b*.

Additionally, pivotally engaging the at least one pivoting feature 630 of the coupling member 106*b* and the at least one pivoting feature 280 of the vertical member 102*a* may further cause the at least one retaining feature 659 of the coupling member 106*b* to contact the first and second sidewalls 262 and 266 of the vertical member 102*a*. Specifically, in the embodiment shown, when the vertical member 102*a* is inserted into the aperture 543 of the coupling member 106*b*: (1) the first sidewall 262 of the vertical member 102*a* may contact the contact surfaces of the inward and downward extending first end arms 661 and 681 of the coupling member 106*b*, and may deflect the first end arms 661 and 681 at their respective hinge points outward; and (2) the second sidewall 266 of the vertical member 102*a* may contact the contact surfaces of the inward and downward extending second end arms 671 and 691 of the coupling member 106*b*, and may deflect the second end arms 671 and 691 at their respective hinge points outward. Similar to that described above in association with coupling member 106*a*, this above step may further retain the vertical member 102*a* within the aperture 543, centre the vertical member 102*a* within the aperture 543, and prevent (or restrict/discourage) any upward movement of the vertical member 102*a* relative to the coupling member 106*b*.

While specific embodiments have been described and illustrated, such embodiments should be considered illustrative of the subject matter described herein and not as limiting the claims as construed in accordance with the relevant jurisprudence.

The invention claimed is:

1. A barrier system comprising a plurality of vertical members and at least one horizontal rail, the barrier system further comprising:

a plurality of coupling members, wherein a coupling member of the plurality of coupling members pivotally couples a vertical member of the plurality of vertical members and the at least one horizontal rail and wherein the coupling member comprises:

at least one pivoting feature formed on opposing coupler member front and rear walls of the coupling member configured to pivotally engage at least one of a vertical member front wall and a vertical member rear wall of the vertical member;

at least one retaining feature formed on an inner surface of at least one of the coupling member front and rear walls configured to contact a sidewall of the vertical member formed between the vertical member front wall and the vertical member rear wall when the coupling member is pivoted about the pivoting feature, and at least one positioning feature configured to engage the at least one horizontal rail.

2. The barrier system of claim 1, wherein the coupling member comprises a first end and a second end and further comprises:

a first support extending between the coupling member front and rear walls proximate the first end; and a second support extending between the coupling member front and rear walls proximate the second end.

3. The barrier system of claim 2, wherein the at least one positioning feature comprises one or more of:

a front flange extending from the coupling member front wall; and a rear flange extending from the coupling member rear wall.

4. The barrier system of claim 3, wherein the at least one positioning feature further comprises one or more of:

a front projection extending from the front flange; and a rear projection extending from the rear flange.

5. The barrier system of claim 2, wherein the at least one pivoting feature comprises one or more of:

a front tab formed in the coupling member front wall and a front projection extending from an inner surface of the front tab; and a rear tab formed in the coupling member rear wall and a rear projection extending from a rear face of the rear tab.

6. The barrier system of any one of claim 2, wherein the coupling member is one of a first coupling member and a second coupling member, wherein the first coupling member and the second coupling member each comprise the first end, the second end, the coupling member front wall, and the coupling member rear wall.

7. The barrier system of claim 6, wherein the at least one pivoting feature of the first coupling member comprises:

an upward facing front tab formed in the first coupling member front wall and a front pivoting projection extending from an inner surface of the upward facing front tab; and an upward facing rear tab formed in the first coupling member rear wall and a rear pivoting projection extending from an inner surface of the upward facing rear tab.

8. The barrier system of claim 7, wherein pivotally engaging the front and rear pivoting projections of the first coupling member with the vertical member front and rear walls restricts downward movement of the vertical member relative to the first coupling member.

9. The barrier system of any claim 6, wherein the at least one retaining feature of the first coupling member comprises:

at least one first arm extending inward and upward proximate the first end of the first coupling member; and at least one second arm extending inward and upward proximate the second end of the first coupling member.

10. The barrier system of claim 6, wherein the at least one pivoting feature of the second coupling member comprises:

a downward facing front tab formed in the second coupling member front wall and a front pivoting projection extending from an inner surface of the downward facing front tab; and a downward facing rear tab formed in the second coupling member rear wall and a rear pivoting projection extending from an inner surface of the downward facing rear tab.

11. The barrier system of claim 10, wherein pivotally engaging the front and rear pivoting projections of the second coupling member with the vertical member front and rear walls restricts upward movement of the vertical member relative to the second coupling member.

12. The barrier system of claim 6, wherein the at least one retaining feature of the second coupling member comprises:

at least one first arm extending inward and downward proximate the first end of the second coupling member; and at least one second arm extending inward and downward proximate the second end of the second coupling member.

13. The barrier system of claim 6, wherein the at least one horizontal rail comprises an upper horizontal rail, at least one middle horizontal rail, and a lower horizontal rail, and wherein:

the first coupling member is configured to pivotally couple the vertical member and the upper horizontal rail; and the second coupling member is configured to pivotally couple the vertical member and one of the at least one middle horizontal rail and the lower horizontal rail.

14. A method of assembling a barrier system comprising a plurality of vertical members and at least one horizontal rail, the method comprising:

engaging at least one positioning feature of a coupling member with a corresponding at least one positioning feature of the at least one horizontal rail; and pivotally engaging at least one pivoting feature formed on opposing coupling member front and rear walls of the coupling member with at least one of a vertical member front wall and a vertical member rear wall of a vertical member of the plurality of vertical members to pivotally couple the vertical member with the at least one horizontal rail, wherein after pivotally engaging the at least one pivoting feature of the coupling member with the least one of the vertical member front and rear walls, and when the coupling member is pivoted about the at least one pivoting feature, at least one retaining feature formed on an inner surface of at least one of the coupling member front and rear walls contacts a sidewall of the vertical member formed between the vertical front member front wall and the vertical member rear wall.

15. The method of claim 14, wherein the at least one positioning feature of the coupling member comprises a front flange extending from the coupling member front wall and a rear flange extending from the coupling member rear wall and the corresponding at least one positioning feature of the at least one horizontal rail comprises a front ledge extending from a horizontal rail front wall of the at least one horizontal rail and a rear ledge extending from a horizontal rail rear wall of the at least one horizontal rail, and engaging the at least one positioning feature of the coupling member with the corresponding at least one positioning feature of the at least one horizontal rail comprises:

contacting the front flange with the front ledge; and contacting the rear flange with the rear ledge.

16. The method of claim 15, wherein the at least one positioning feature of the coupling member further comprises a front positioning projection extending from the front flange and a rear positioning projection extending from the rear flange and the corresponding at least one positioning feature of the at least one horizontal rail further comprises a front recess in the front ledge and a rear recess in the rear ledge, and engaging the at least one positioning feature of the coupling member with the corresponding at least one positioning feature of the at least one horizontal rail comprises:

receiving the front projection in the front recess; and receiving the rear projection in the rear recess.

17. The method of claim 15, wherein the at least one pivoting feature of the coupling member comprises a front tab comprising a front pivoting projection formed in the coupling member front wall and a rear tab comprising a rear pivoting projection formed in the coupling member rear wall and pivotally engaging the at least one pivoting feature of the coupling member with the at least one of the vertical member front and rear walls comprises:

deflecting the front tab to removably insert the front pivoting projection into a front aperture formed in the vertical member front wall; and deflecting the rear tab to removably insert the rear pivoting projection into a rear aperture formed in the vertical member rear wall.

18. The method of claim 15, wherein:

the at least one horizontal rail comprises an upper horizontal rail and one or more of at least one middle horizontal rail and a lower horizontal rail, and the coupling member is one of a first coupling member and a second coupling member, wherein the first and second coupling members each have the coupling member front wall and the coupling member rear wall.

19. The method of claim 18, wherein:

the at least one pivoting feature of the first coupling member comprises:

an upward facing front tab comprising a front pivoting projection formed in the first coupling member front wall; and an upward facing rear tab comprising a rear pivoting projection formed in the first coupling member rear wall, the at least one retaining feature of the first coupling member comprises:

at least one first arm extending inward and upward proximate a first end of the first coupling member; and at least one second arm extending inward and upward proximate a second end of the first coupling member;

engaging the at least one positioning feature of the coupling member with the corresponding at least one positioning feature of the at least one horizontal rail comprises engaging the at least one positioning feature of the first coupling member with a corresponding at least one positioning feature of the upper horizontal rail; and pivotally engaging the at least one pivoting feature of the coupling member with the at least one of the vertical member front and rear walls comprises:

removably inserting the front pivoting projection into a front aperture formed in the vertical member front wall;

removably inserting the rear pivoting projection into a rear aperture formed in the vertical member rear wall;

deflecting the at least one first arm with a first sidewall of the vertical member, wherein the inward and upward extension of the at least one first arm biases the at least one first arm to contact the first sidewall; and deflecting the at least one second arm with a second sidewall of the vertical member, wherein the inward and upward extension of the at least one second arm biases the at least one second arm to contact the second sidewall.

20. The method of claim 18, wherein:

the at least one pivoting feature of the second coupling member comprises:

a downward facing front tab comprising a front pivoting projection formed in the second coupling member front wall; and a downward facing rear tab comprising a rear pivoting projection formed in the second coupling member rear wall;

the at least one retaining feature of the second coupling member comprises:

at least one first arm extending inward and downward proximate a first end of the second coupling member; and at least one second arm extending inward and downward proximate a second end of the second coupling member;

engaging the at least one positioning feature of the coupling member with the corresponding at least one positioning feature of the at least one horizontal rail comprises engaging the at least one positioning feature of the second coupling member with a corresponding at least one positioning feature of one of the at least one middle horizontal rail and the lower horizontal rail; and pivotally engaging the at least one pivoting feature of the coupling member with the at least one of the vertical member front and rear walls comprises:

removably inserting the front pivoting projection into a front aperture formed in the vertical member front wall;

removably inserting the rear pivoting projection into a rear aperture formed in the vertical member rear wall;

deflecting the at least one first arm with a first sidewall of the vertical member, wherein inward and downward extension of the at least one first arm biases the at least one first arm to contact the first sidewall; and deflecting the at least one second arm with a second sidewall of the vertical member, wherein the inward and downward extension of at least one second arm biases the at least one second arm to contact the second sidewall.

* * * * *